US006347207B1

(12) United States Patent
Ishiguro et al.

(10) Patent No.: US 6,347,207 B1
(45) Date of Patent: Feb. 12, 2002

(54) DEVELOPING UNIT AND TONER REPLENISHING DEVICE WITH CONVEYING APPARATUS

(75) Inventors: Yasuyuki Ishiguro, Higashiosaka; Toshio Nishino, Yamotokoriyama; Hiroshi Tanisawa, Nara; Yoshinori Otsuka, Tenri; Jun Yamaguchi, Ikoma; Tsutomu Nagata, Hirakata; Haruko Yoneda; Naotaka Funayama, both of Tenri, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/443,337

(22) Filed: Nov. 19, 1999

(30) Foreign Application Priority Data

Dec. 15, 1998 (JP) ..... 10-355836
Mar. 11, 1999 (JP) ..... 11-064206
Apr. 16, 1999 (JP) ..... 11-108713

(51) Int. Cl.[7] ..... G03G 15/08
(52) U.S. Cl. ..... 399/258; 399/260; 399/263
(58) Field of Search ..... 399/254, 255, 399/258–260, 262, 263

(56) References Cited

U.S. PATENT DOCUMENTS 4,647,180 A * 3/1987 Watanabe ..... 399/258
5,202,732 A * 4/1993 Yahata ..... 399/263
5,640,651 A 6/1997 Katoh et al.
5,729,803 A * 3/1998 Nakaue et al. ..... 399/260 X
5,761,589 A 6/1998 Kido et al.
5,794,109 A 8/1998 Ota et al.
6,026,263 A * 2/2000 Nakahata et al. ..... 399/263
6,049,689 A 4/2000 Ishii et al.
6,094,550 A 7/2000 Kido et al.
6,128,453 A * 10/2000 Ban et al. ..... 399/262 X

FOREIGN PATENT DOCUMENTS

JP 63-213877 9/1988
JP 06-236110 8/1994
JP 07-271163 10/1995
JP 10-123815 5/1998

* cited by examiner

*Primary Examiner*—William J. Royer

(57) ABSTRACT

A developing unit includes a developer hopper, a toner reserve container that incorporates a replenishing roller and a replenishing opening forming a toner replenishing portion, arranged adjacent to the developer hopper in order to replenish the toner to the developer hopper. The toner reserve container further includes an agitator rotatable about a rotary shaft with a conveying sheet for conveying the toner to the replenishing roller. The conveying sheet is attached to the agitator so that it becomes close to the rotary shaft of the agitator. By this configuration, an adequate space can be secured between the top plate, i.e., an operable/closable lid, constituting the toner reserve container and the conveying sheet so that the distal part of the conveying sheet can efficiently retain the toner, thus making it possible to improve the conveyance performance to the replenishing roller and realize an uniform amount of conveyance.

14 Claims, 11 Drawing Sheets

DEVELOPING UNIT AND TONER REPLENISHING DEVICE WITH CONVEYING APPARATUS

BACKGROUND OF THE INVENTION (1) Field of the Invention

The present invention relates to a developing unit for use in an image forming apparatus such as a laser printer, copier, facsimile machine etc., and in particular relates to a technology for replenishing, as required, the toner for image development to the developer hopper as a part of a developing unit.

(2) Description of the Prior Art

An image forming apparatus such as a laser printer, copier, facsimile machine utilizing the electrophotographic technique, has an image forming portion for forming a desired image on a sheet for recording. In this image forming portion, the surface of a photoreceptor as an image bearer is uniformly electrified with charge of a particular polarity and then is illuminated with an optical image so as to form a static latent image corresponding to the image. For the purpose of visualizing this static latent image, the image forming portion includes a developing unit and other components. The developing unit is configured of a developer hopper holding a developer and having a developing roller for replenishing the developer to the developing position where the developing roller opposes the photoreceptor. Further, since the toner in the developer hopper is consumed, a toner replenishing device for supplying the toner to the developer hopper as necessary is arranged adjacent to the developer hopper.

In a developing unit of the above type, if the toner reserve container for replenishing the developer to the developer hopper is arranged on the top, the developing unit would be bulky as to its height so a waste space would arise inside the image forming apparatus, thus making the whole image forming apparatus bulky. For this reason, the toner reserve container is horizontally arranged adjacent to the developer hopper to reduce the height of the developing unit, thus making the developing unit into a thinned configuration and hence making it possible to configure a compact image forming apparatus as a whole by eliminating the unnecessary space which would arise inside the image forming apparatus.

An example of such a developing unit is disclosed in Japanese Patent Application Laid-Open Sho No. 63-213877. In this developing unit, the toner reserve container is arranged at the side of the developing hopper and has a conveying element that conveys and agitates the toner inside the toner reserve container so that the conveying element feeds (replenishes) the toner into the toner replenishing portion from which the toner is replenished to the developer hopper.

Japanese Patent Application Laid-Open Hei No. 10-123815 has proposed a developing unit having a toner replenishing device having a simpler configuration compared to the developing unit disclosed in the aforementioned publication. This developing unit 60 comprises, as shown in FIG. 1, a developer hopper 61 which incorporates an agitating roller 62 for agitating the developer stored in developer hopper 61 and a developing roller 63 for conveying the developer to the developing area that opposes the photoreceptor. Further, a toner reserve container 64 is horizontally arranged at the side of developer hopper 61. Toner reserve container 64 stores toner 69 for replenishment and incorporates an agitator 65 that agitates and conveys the stored toner 69.

Formed between developer hopper 61 and toner reserve container 64 is a toner supply opening 66, at which a toner replenishing roller 67 made up of sponge for replenishing the toner into developer hopper 61 is positioned. The agitator 65 is rotated in the direction of the arrow in the drawing during toner replenishment so as to feed the toner to replenishing roller 67 whilst agitating the toner stored in toner reserve container 64.

Agitator 65 is configured of rotational, agitating vanes (a pair of plates arranged on both sides) with a conveying sheet 68 of a flexible sheet-like element, attached atone end of the vanes. Accordingly, as agitator 65 is turned, conveyer sheet 68 scoops up the toner 69 accumulated or stored at the bottom of toner reserve container 64 whilst agitating it and collects the toner thereover to feed it to replenishing roller 67. During this, the toner 69 covering the sheet is supplied to replenishing roller 67 by making use of the force of action that causes conveying sheet 68 to restore itself due to its own flexibility.

In a developing unit of this kind, toner reserve container 64 is arranged at the side, and the agitator 65 is provided in the toner reserve container 64, whereby toner 69 in toner reserve container 64 can be conveyed completely to toner replenishing roller 67. Thus, the toner storage volume can be increased by enlarging the developing unit horizontally while the height of the developing unit can be suppressed.

In the developing unit shown in FIG. 1, since toner reserve container 64 is horizontally arranged at the side of developer hopper 61, there is no increase in height. However, if the toner storage volume of toner reserve container 64 is further increased, the height cannot but increase.

If toner reserve container 64 is enlarged only in the horizontal direction in order to increase the toner storage volume, agitator 65 shown in FIG. 1 cannot agitate and convey the toner well enough. That is, if the distance of conveying sheet 68 from the fixed end to the distal end is set long enough to convey the toner in the vertical direction, it is difficult to secure good enough performances of agitation and conveyance of the toner in the lateral direction. As a result, the toner inside toner reserve container 64 cannot be completely used and a certain toner will remain unused. Further, the remaining toner is not agitated and hence the toner gathers into a mass in the stationary area, which may then be fed into the agitatable area by some reason such as vibration, for instance, and hence the aggregation may be fed to replenishing roller 67. When such a toner aggregation is fed to developer hopper 61, it may cause development failures, or other deficiencies.

For these reasons, in the apparatus disclosed in Japanese Patent Application Laid-Open Hei No. 10-123815, the rotary shaft 65*a* of agitator 65 is set off-centered closer to the developer hopper 61 side while conveying sheet 68 when it is positioned horizontally is formed long enough so that its front end reaches the right side wall (rear wall) of toner reserve container 64 in FIG. 1, whereby toner supply can be stabilized while securing a desired amount of toner for replenishment and eliminating toner stagnation. In FIG. 1, a reference numeral 71 designates a regulating element for limiting the developer adhering to developing roller 63 to the predetermined amount and 72 designates a concentration detector for detecting the toner concentration of the developer in developer hopper 61.

Here, in accordance with the toner replenishing device having a configuration shown in FIG. 1, toner 69 in toner reserve container 64 is adapted to be scooped up and fed to the replenishing portion from above to replenishing roller 67. In contrast to this, those disclosed in Japanese Patent Application Laid-Open Hei No. 6-236110 and Japanese Patent Application Laid-Open Hei No. 7-271163 are configured so that the toner in the toner reserve container is scooped up and fed from below. In these cases where the toner is fed in such a manner, the rotary shaft of the agitator needs to be positioned above the replenishing portion so that the configuration inevitably tends to be greater in height.

Here, the developing unit having a configuration shown in FIG. 1, particularly, agitator 65 rotatably provided in toner reserve container 64 for toner replenishment is configured to be symmetrical with respect to rotary shaft 65*a*. In other words, agitator 65 is set so that the distance from the center of rotary shaft 65 to either end is constant, and conveying sheet 68 is attached to one of the ends.

Therefore, when agitator 65 is set vertically as shown in FIG. 1, conveying sheet 68 is positioned horizontally and comes closer to a top openable/closable lid 70 of toner reserve container 64. In other words, the distance between openable/closable lid 70 and conveying sheet 68 is very short. Hence, when agitator 65 is turned in the direction shown in the drawing, a mid part of conveying sheet 68 comes into contact with the openable/closable lid 70, whereby the scooped toner falls out of the distal end of conveying sheet 68 and hence it becomes difficult to feed a sufficient enough amount of toner to the position of replenishing roller 67. Further, conveying sheet 68 is deformed excessively so that a large amount of toner spills from the retaining sheet.

Besides, as shown in the drawing, the distal part of conveying sheet 68 is formed with a flexed portion 68*a* (bent with an angle θ) so as to scoop up the toner adequately. This configuration is to secure a sufficient amount of toner to be supplied to toner replenishing roller 67. However, even with this configuration, when agitator 65 is turned, a mid portion, in place of the distal end, of conveying sheet 68 may come first into contact with top openable/closable lid 70 as described above, or conveying sheet 68 may be deformed excessively, so that a large amount of the toner scooped up by flexed portion 68*a* at the distal end of the sheet will conceivably fall out.

Further, when conveying sheet 68 is turned by agitator 65 to scoop up the toner and supply the toner while being in contact with openable/closable lid (top plate) 70, the sheet is greatly deformed and curved by the contact. In this case, if the sheet is greatly curved and flexed but the flexure is not uniform across the full length of the rotational axis (in the longitudinal direction), the supplied amount of the toner to replenishing roller 67 will vary and fluctuate. Specifically, if the flexure of conveying sheet 68 is irregular along the rotational axis of replenishing roller 67, the supplied amount of the toner across the length in the axial direction will not be uniform, presenting local deficiencies of toner. For this reason, the toner supplied to the developer hopper 61 side by replenishing roller 67 greatly varies across the length in the rotational axis direction, which in turn, appears as image unevenness due to fluctuations of toner concentration.

SUMMARY OF THE INVENTION

In view of the above problems, it is an object of the present invention to provide a developing unit equipped with a toner replenishing device wherein the toner in the toner reserve container can be sufficiently fed and conveyed to the toner replenishing portion with an improved efficiency.

It is another object of the invention to eliminate partial toner supply and hence local fluctuations of the development density so as to realize development with substantially uniform density as a whole, in particular, across the length in the axial direction.

It is a further object of the invention to provide a developing unit which is simplified in its structure in order to realize sufficient replenishment of the toner to the toner replenishing portion.

In order to achieve the above object, the present invention is configured as follows:

In accordance with the first aspect of the present invention, a developing unit equipped with a toner replenishing device having a toner reserve container for replenishing the toner to a developer hopper as required and a replenishing portion for supplying the toner stored in the toner reserve container to the developer hopper, includes:

a rotator incorporated in the toner reserve container so as to be rotatable for agitating the stored toner; and a conveying sheet of a flexible material arranged so as to become closer to the rotary shaft of the rotator, for scooping up the stored toner and conveying it to the replenishing portion.

In accordance with the second aspect of the present invention, a developing unit equipped with a toner replenishing device having a toner reserve container for replenishing the toner to a developer hopper as required and a replenishing portion for supplying the toner stored in the toner reserve container to the developer hopper, includes:

a rotator incorporated in the toner reserve container so as to be rotatable for agitating the stored toner; and a conveying sheet of a flexible material attached to the rotator for scooping up the stored toner and conveying it to the replenishing portion, and is characterized in that the top plate of the toner reserve container with which the distal end of the conveying sheet comes in contact is provided with a recessed portion, projected portion or rough-faced portion made up of one or multiple sections or any combination of these so as to briefly grip the distal end of the conveying sheet.

In accordance with the third aspect of the present invention, the developing unit equipped with a toner replenishing device having the above first feature is characterized in that the top plate constituting the upper part of the toner reserve container has a portion inclined or curved toward the replenishing portion so as to prevent the conveying sheet from abruptly springing back from its flexed state to its original shape when the conveying sheet feeds the toner to the replenishing portion as its distal end abuts against and slides along the top plate and allows the conveying sheet to gradually restore itself.

In accordance with the fourth aspect of the present invention, the developing unit equipped with a toner replenishing device having the above second feature is characterized in that the top plate constituting the upper part of the toner reserve container has a portion inclined or curved toward the replenishing portion so as to prevent the conveying sheet from abruptly springing back from its flexed state to its original shape when the conveying sheet feeds the toner to the replenishing portion as its distal end abuts against and slides along the top plate and allows the conveying sheet to gradually restore itself.

In accordance with the fifth aspect of the present invention, the developing unit equipped with a toner replenishing device having the above third feature is characterized in that the inclined or curved portion formed in the top plate originates from the point where the conveying sheet starts reverting itself to its original shape from its maximally flexed state.

In accordance with the sixth aspect of the present invention, the developing unit equipped with a toner replenishing device having the above fourth feature is characterized in that the inclined or curved portion formed in the top plate originates from the point where the conveying sheet starts reverting itself to its original shape from its maximally flexed state.

In accordance with the seventh aspect of the present invention, the developing unit equipped with a toner replenishing device having the above third feature is characterized in that the inclined or curved portion of the top plate is angled with an angle θ1 which is equal to or smaller than 15 degrees.

In accordance with the eighth aspect of the present invention, the developing unit equipped with a toner replenishing device having the above fourth feature is characterized in that the inclined or curved portion of the top plate is angled with an angle θ1 which is equal to or smaller than 15 degrees.

In accordance with the ninth aspect of the present invention, the developing unit equipped with a toner replenishing device having the above first feature is characterized in that the conveying sheet is formed with such a length that its distal end is placed in proximity to the rear wall of the toner reserve container when the conveying sheet is positioned in parallel to the top plate of toner reserve container and the distal end part is flexed at an angle θ to form a toner retainer.

In accordance with the tenth aspect of the present invention, the developing unit equipped with a toner replenishing device having the above second feature is characterized in that the conveying sheet is formed with such a length that its distal end is placed in proximity to the rear wall of the toner reserve container when the conveying sheet is positioned in parallel to the top plate of toner reserve container and the distal end part is flexed at an angle θ to form a toner retainer.

In accordance with the eleventh aspect of the present invention, the developing unit equipped with a toner replenishing device having the above second feature is characterized in that the recessed, projected or rough-faced portion formed on the top plate constituting the toner reserve container is formed of multiple sections arranged one behind another with respect to the rotational direction of the conveying sheet, and the recessed, projected or rough-faced section on the downstream side provides a stronger grip than that on the upstream side.

In accordance with the twelfth aspect of the present invention, the developing unit equipped with a toner replenishing device having the above second feature is characterized in that the recessed, projected or rough-faced portion formed on the top plate constituting the toner reserve container is formed close to the replenishing portion.

In accordance with the thirteenth aspect of the present invention, the developing unit equipped with a toner replenishing device having the above second feature is characterized in that the conveying sheet is attached at its one end in proximity to the rotary shaft of the rotator.

In accordance with the fourteenth aspect of the present invention, the developing unit equipped with a toner replenishing device having the above second feature is characterized in that the rough-faced portion formed on the top plate constituting the toner reserve container is specified so that the mean roughness (Ra) is set within the range of 5 to 500 μm and the maximum roughness (Rmax) is set within the range of 15 to 1500 μm.

The features of the invention are as above, and the operational effects produced by the above features of the invention will be described hereinbelow.

First, by the configuration of the above first feature, the toner stored in the toner reserve container is fed (conveyed) by the conveying sheet to the toner replenishing portion as the rotator turns. During this, with its distal end abutting against the top plate forming the upper part of the toner reserve container, the conveying sheet is being deformed and largely flexed and moves along the top plate, retaining and conveying the toner to the replenishing portion. Since the conveying sheet is attached to a certain point so that it comes closer to the rotary shaft of the rotator, it is possible to secure a distance from the top plate and hence avoid the sheet being excessively flexed by the top plate. Therefore, it is possible to prevent the toner retained on the sheet from locally spilling out and hence prevent local degradation of conveyance of the toner. Accordingly, conveyance of feeding the toner in the toner reserve container to the replenishing portion can be enhanced, in particular, the toner can be conveyed practically uniform across the full range of the rotary shaft. Resultantly, the amount of the toner supplied to the developer hopper as a part of the developing unit can be made substantially uniform across the full length in the axial direction, thus making it possible to beneficially keep the developing density without causing any local variations in developing density.

In accordance with the configuration of the second feature, with the rotation of the rotator, the conveying sheet turns and scoops up the stored toner. When the sheet comes in contact with the top plate, it becomes curved and flexed. As the sheet is bent more, the sheet will not be flexed uniformly across the length along the rotary shaft and local irregularities of the bending state tend to be stronger. In this state, when the distal end of the conveying sheet is caught by the recessed portion, projected portion or rough-faced portion, local irregularities of the bending state of the sheet can be corrected so as to be uniform. In this way, the bending state is made uniform so that the toner scooped and retained by the conveying sheet can be uniformly supplied to the replenishing portion across the full range along the axial direction, thus making the distribution of toner concentration in the developing unit after toner replenishment uniform. This leads to uniform toner density after development. Here, use of the recessed portion, projected portion or rough-faced portion made up of multiple sections or combination of these is effective in reliably and efficiently uniformly correct the bending state of the conveying sheet.

By the provision of the configurations defined by the third and fourth features, the conveying sheet that comes in contact with the top plate and hence is deformed, can be prevented from flicking the toner excessively by its repulsive force and degrading its conveyance capability when the sheet reverts itself back to its original shape while the conveying sheet feeds the retained toner to the replenishing portion. Therefore, occurrence of local conveyance failures can be avoided to thereby enable a more stable conveyance. That is, the configuration of the top plate inclined or curved toward the replenishing portion can reduce the strong repulsive force when the conveying sheet restores to its original state and enables beneficial conveyance of the toner retained by the conveying sheet to the replenishing portion.

Next, in accordance with the configurations of the fifth and sixth features, the inclined or curved portion formed in the top plate originates from the point where the conveying sheet starts reverting itself to its original shape from its maximally flexed state. Therefore, this configuration makes it possible to reduce the strong repulsive force when the conveying sheet restores to its original state and hence promote the effect of improving the conveying performance, improving the conveying performance of the toner to the replenishing portion, thus further stabilizing toner replenishment to the developer hopper.

In accordance with the configurations of the seventh and eighth features, the inclined or curved portion of the top plate is angled with an angle θ1 which is equal to or smaller than 15 degrees. In this case, if the angle θ1 exceeds 15 degrees, the conveying sheet may be deformed excessively and hence the retained toner would locally spill out, causing local irregularities in toner conveyance to the replenishing portion. In this configuration, setting of the angle θ1 equal to or smaller than the 15 degrees enables beneficial retaining of the toner and maintains stable conveyance of the toner.

By the provision of the configurations defined by the ninth and tenth features, the toner stored in the toner reserve container can be fully agitated by the conveying sheet and almost all the toner can be conveyed to the replenishing portion. Further, positioning of the rotator or the rotary shaft off the center to the developer hopper side facilitates beneficial agitation and conveyance of the stored toner even if the toner reserve container is formed so that its horizontal dimension is elongated. Further, since the distal end of the conveying sheet is flexed at an angle □, it is possible to realize a further enhanced toner retaining state and stabilized conveyance.

In accordance with the configuration of the eleventh feature, the bending state of the conveying sheet can be corrected uniformly, and then the distal end of the sheet is gripped by the final, large recessed, projected or rough-faced portion so as to adequately bend the sheet retaining the toner thereon when it replenishes the toner to the replenishing portion. Therefore, it is possible to flick the toner by this elastic action of the flexure, realizing a stable replenishment as well as an ample amount of toner supply.

Next, according to the configuration of the twelfth feature, it is possible to reform the bending state of the conveying sheet being curved near the replenishing portion uniformly. Therefore, it is possible to realize stable toner supply and uniform toner replenishment across the full range in the axial direction.

According to the configuration of the thirteenth feature, since the bending amount of the conveying sheet can be reduced, it is possible to further stabilize the bending state while improving the toner retaining capacity. In combination with this effect, the bending state can be corrected by the recessed or projected portion. Therefore, it is possible to further enhance stable toner supply, uniformity of the replenished amount, in particular uniformity of the replenished amount across the full range in the axial direction.

Finally, setting of the surface roughness according to the fourteenth feature, further enhances the reliability of gripping the conveying sheet. Further, the sheet can be smoothly regulated instead of being abruptly stopped, thus making it possible to avoid the scooped toner held by the conveying sheet from falling and hence realize a further stabilized toner feeding.

DESCRIPTION OF THE PREFERRED EMBODIMENTS

Figure 2:
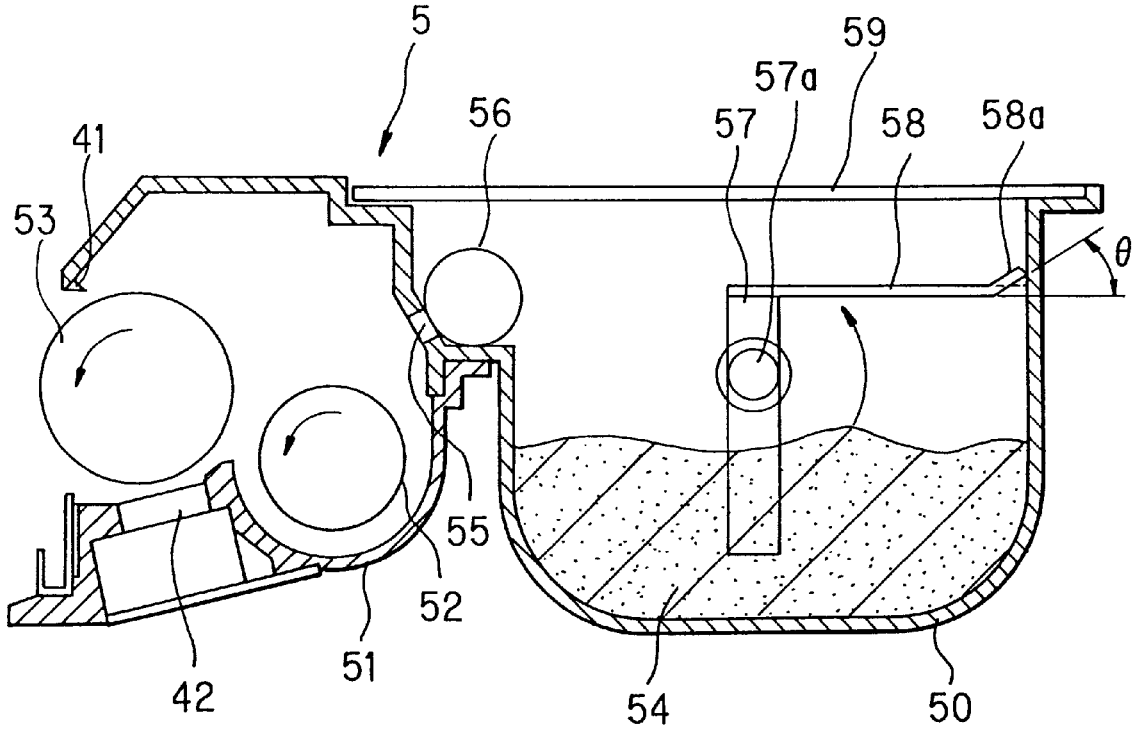
FIG. 2 is a sectional view for showing and explaining the structure of a developing unit equipped with a toner replenishing device in accordance with the first embodiment of the present invention.
Figure 3A:
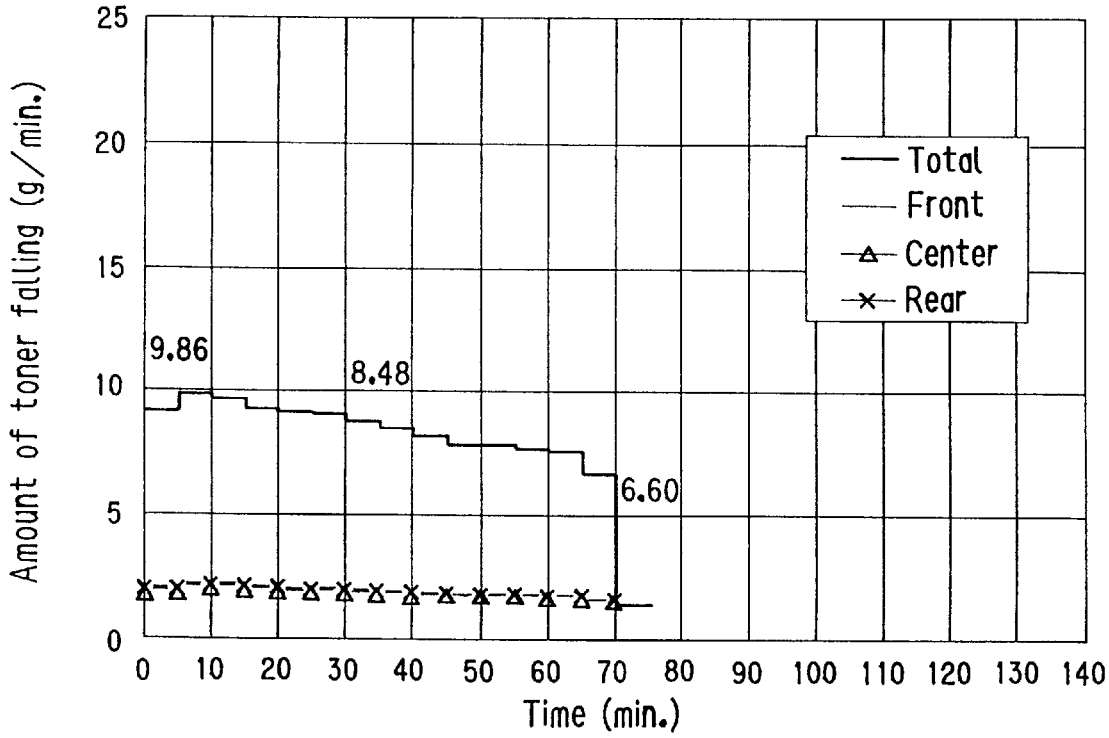
FIGS. 3A and 3B are experimental, characteristic charts to illustrate time-dependent evolution of toner replenishment to the developer hopper by the toner replenishing device of the first embodiment of the invention, taking replenishing time along their abscissa and toner replenished (toner falling) amount along their ordinate, FIG. 3A showing the result of the present invention shown in FIG. 2 and FIG. 3B showing the result of the conventional configuration.
Figure 3B:
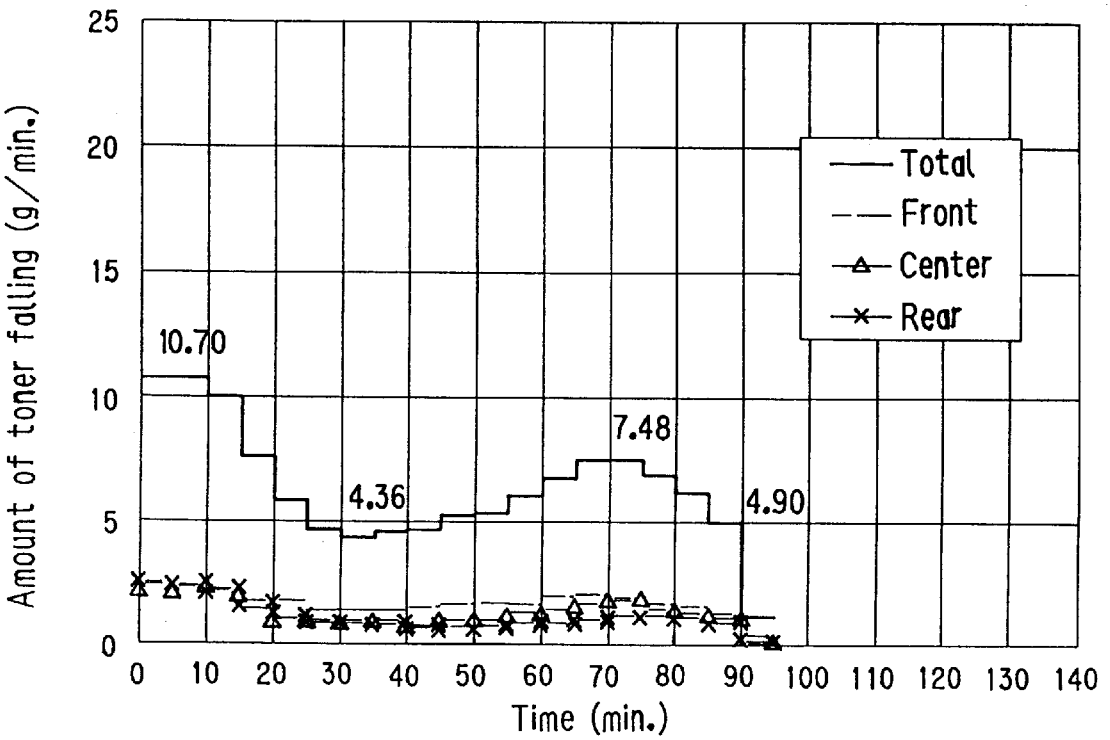
Figure 4A:
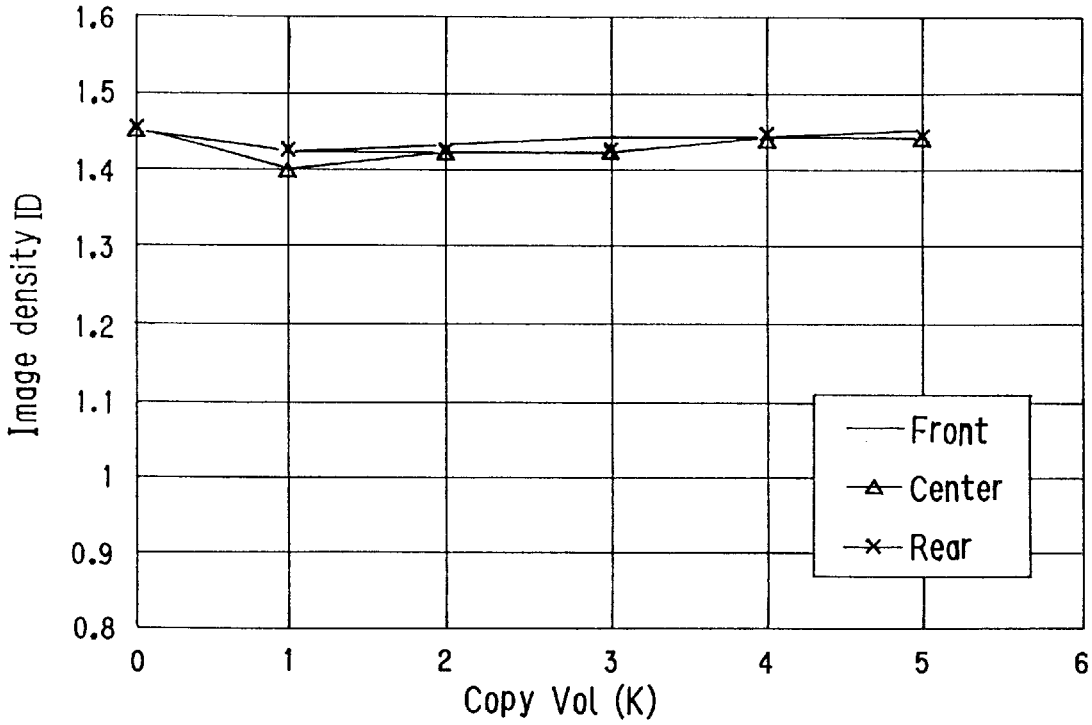
FIGS. 4A and 4B are characteristic charts showing copy volume-dependent evolution of actually developed image forming results in association with the toner replenished states shown in FIGS. 3A and 3B, taking copy volume along their abscissa and the developed image density (ID) along their ordinate, FIG. 4A showing the result of the present invention and FIG. 4B showing the result of the conventional configuration.
Figure 4B:
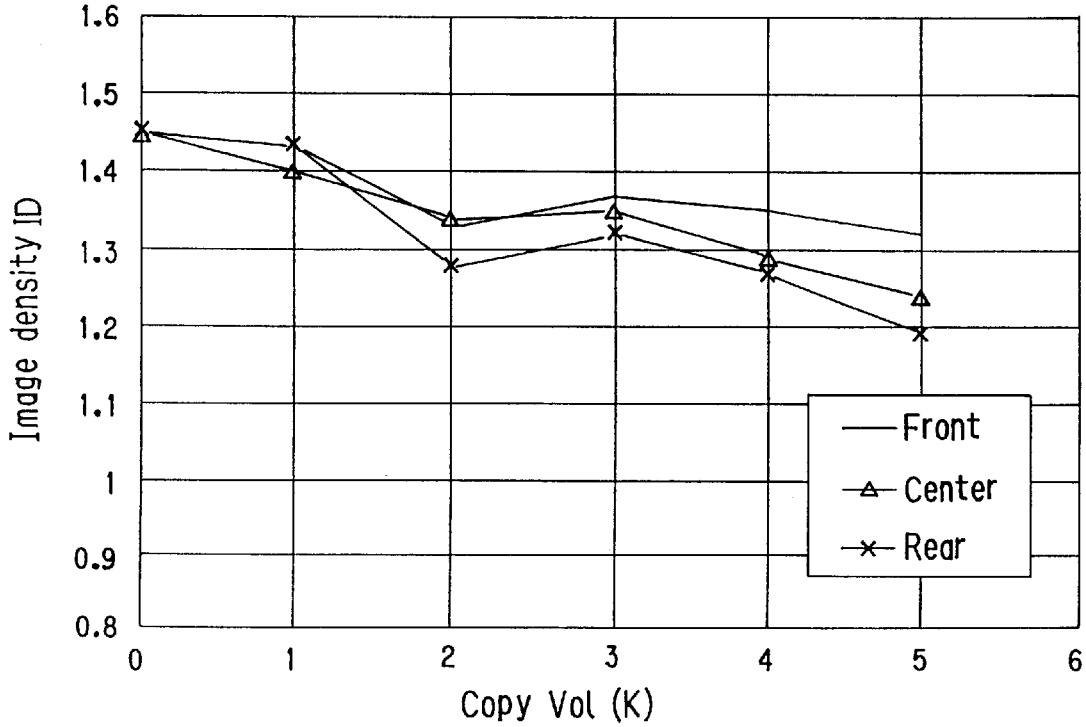
Figure 5:
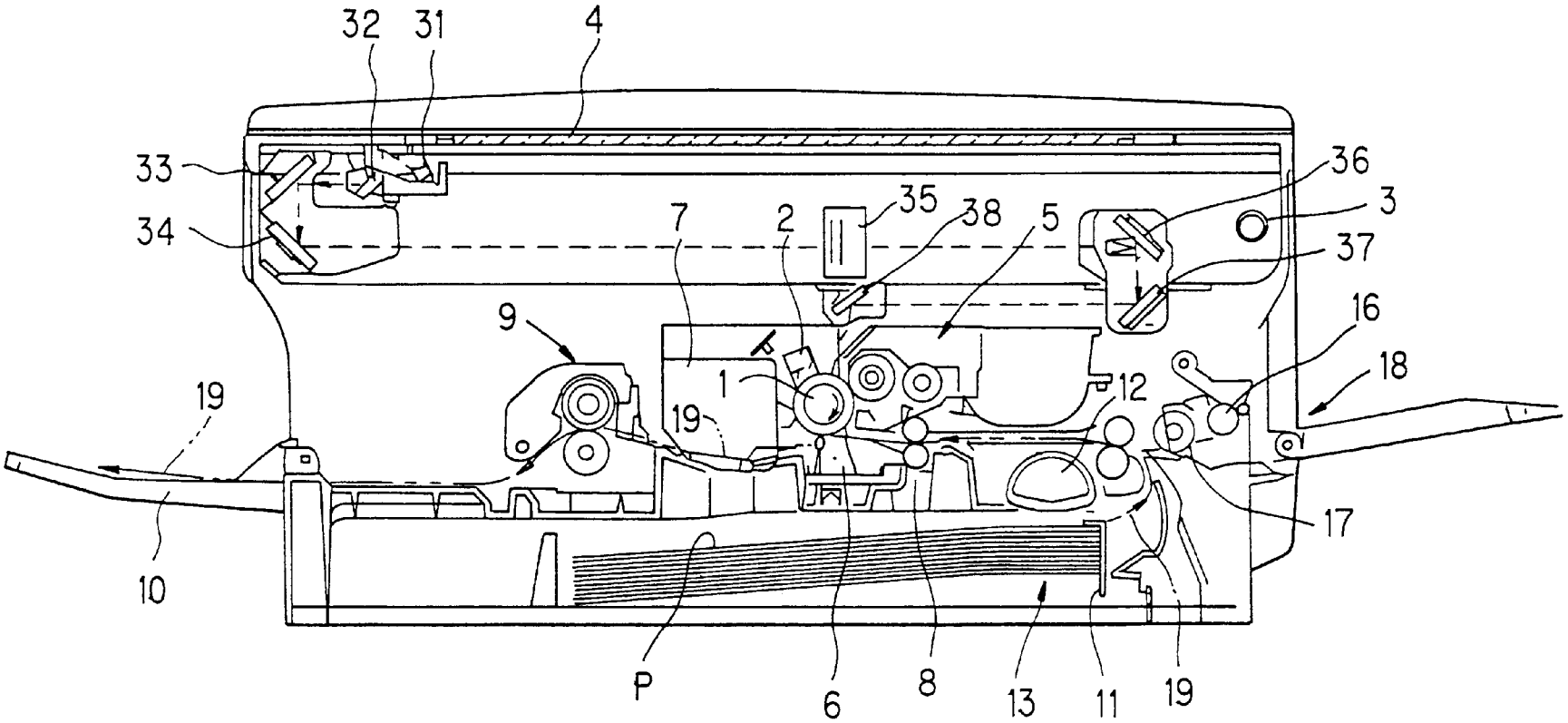
FIG. 5 is a sectional view showing an example of the overall configuration of an image forming apparatus having a developing unit equipped with a toner replenishing device shown in FIG. 2.

The embodiments of the present invention will hereinafter be described in detail with reference to the accompanying drawings. FIG. 2 is a sectional view for illustrating the first embodiment of a developing unit equipped with a toner replenishing device in accordance with the present invention. FIGS. 3A and 3B are charts to illustrate time-dependent evolution of toner replenishment by the toner replenishing device in the developing unit of the first embodiment of the present invention, FIG. 3A showing the result of the present invention and FIG. 3B showing time-dependent evolution of toner replenishment in the conventional configuration shown in FIG. 1. FIGS. 4A and 4B are charts showing copy volume-dependent evolution of developed image density by the developing unit as the toner is replenished to the developer hopper, FIG. 4A showing the characteristics of the developed image density of the present invention and FIG. 4B showing the characteristics of the developed image density of the developing unit shown in FIG. 1. FIG. 5 is a sectional view showing the internal structure of a copier as an example of an image forming apparatus having a developing unit equipped with a toner replenishing device of the present invention shown in FIG. 2.

To begin with, before description of the first embodiment of a developing unit of the present invention, the image forming apparatus shown in FIG. 5 will be described. The developing unit equipped with a toner replenishing device of the present invention can not only be applied to copiers but of course directly applied to the developing units of printers, facsimile machines, etc., which use electrophotography.

As shown in FIG. 5, the copier has an image forming portion composed of, in its center, a photoreceptor 1 which rotates in a direction indicated by the arrow, a main charger 2 uniformly charging the photoreceptor; a developing unit 5 for developing the electrostatic latent image which has been formed on the photoreceptor by illuminating the image of the original placed on an original table 4 through an optical system 3; a transfer device 6 for transferring the toner image formed on the photoreceptor to a sheet which has been fed by a sheet feeding device described below; a cleaning unit 7 for removing the leftover toner after transfer; and the like.

Optical system 3 for illuminating photoreceptor 1 with the image of the original includes: a scanner composed of an exposure lamp 31 disposed below original table 4 for illuminating the original and mirrors 32, 33 and 34 which properly reflect the reflected light from the original; a lens 35 focusing the reflected light from the original onto the surface of photoreceptor 1; and fixed reflection mirrors 36, 37 and 38 which finally lead the reflected light from the original onto photoreceptor 1. Accordingly, the first scanner portion composed of mirror 32 and exposure lamp 31 as part of the scanner is made to travel at a uniform speed along original table 4, while the second scanner portion composed of mirrors 33 and 34 is made to travel in the same direction as the first scanner portion but at half the speed of that of the first scanner portion. By this operation, the image of the original can be sequentially exposed slit-wise to light as photoreceptor 1 rotates, making it possible to create a focused image of the original image on the surface of photoreceptor 1.

There is also a configuration in which, instead of optical system 3 of the above configuration, the image of an original is digitally captured by focusing the image via a focusing lens 35 on an image reading device of photoelectric conversion elements, for example, a CCD or the like so that photoreceptor 1 is illuminated with a laser beam from a semiconductor laser which is selectively controlled based on the captured image data. This configuration is known as a digital copier. The configuration shown in FIG. 5 is of an analog copier and distinguished from the digital copier.

When optical system 3 exposes the photoreceptor to the original image (optical image), a static latent image in accordance with the original image is formed on the surface of photoreceptor 1 which has been uniformly charged by main charger 2. This static latent image is developed in the next step, i.e., developing unit 5, where toner as a coloring agent is made to adhere so as to create a visual image.

The toner image created on the surface of photoreceptor 1 is transferred by the action of transfer device 6 to a sheet which is being conveyed as appropriate from the sheet feeding device. The sheet has been previously conveyed up to the position of registration rollers 8, and is delivered out by registration rollers 8 to the transfer station (image forming station) facing transfer device 6, at the timing in synchronization with the rotary movement of photoreceptor 1.

The sheet after transfer is separated from the surface of photoreceptor 1 and then is conveyed along the guide surface to heat fixing roller 9. As it passes through heat fixing roller 9, the toner image formed on the sheet is fixed as a permanent image. Thereafter the sheet is discharged onto a sheet output tray 10 which is projected out from the copier body.

Next, the sheet feeding device for feeding sheets to registration rollers 8 will be described. The sheet feeding device includes: a cassette feeder portion 13 which is disposed in the lower part of the copier body and is composed of a sheet cassette 11 which can be detachably fitted to the machine body (can be withdrawn to the front side in the drawing) and a sheet feed roller 12 for delivering sheets P accommodated in the cassette; a sheet tray on which a multiple number of sheets P can be placed; and a manual paper feeder 18 composed of a pickup roller 16 over and opposing the tray, a sheet feed roller 17 for separating and feeding the sheet P delivered by pickup roller 16.

In the figure, a reference numeral 19 shows the conveyance path of sheet P fed from the sheet feeding device, in particular, from cassette feeder portion 13.

Next, description will be made of the first embodiment of developing unit 5 in accordance with the present invention in which toner conveyance performance to the toner replenishing portion is particularly improved by its toner replenishing device.

The First Embodiment of the Present Invention

FIG. 2 shows the configuration of developing unit 5 in accordance with the first embodiment of the present invention as stated heretofore. In FIG. 2, developer unit 5 has a toner replenishing device having a toner reserve container 50 storing the toner. This toner reserve container 50 is horizontally arranged at the side of a developing hopper 51 as a part of developing unit 5.

As conventionally known, developer hopper 51 storing the developer in developing unit 5 is provided with a rotatable, agitating roller 52 for agitating and conveying the developer stored therein and a rotatable, developing roller 53 for conveying the developer to the developing area facing the image forming portion shown in FIG. 5, in particular, photoreceptor 1, so as to perform development. The aforementioned toner reserve container 50 is arranged adjacent to developer hopper 51.

Though not illustrated, when the developer is comprised of a toner and a carrier, the developing roller 53 is configured of a nonmagnetic, cylindrical sleeve and a magnet assembly having multiple magnetic poles accommodated therein. As the sleeve is rotated counterclockwise as shown in FIG. 2 the developer attracted by the magnetic force of the magnet assembly is conveyed in the counterclockwise direction into the developing area facing photoreceptor 1. A regulating blade 41 is provided at a position midway to conveyance and is kept away from the sleeve surface in order to limit the amount of the developer adhering to developing roller 53.

Toner reserve container 50 constituting developing unit 5 of the present invention is a container for storing a toner 54 to be replenished to developer hopper 51 as required. A supplying port 55 through which toner 54 is supplied is formed between toner reserve container 50 and adjacent developer hopper 51. A toner replenishing roller 56 is rotatably arranged in such a manner that part of the peripheral surface thereof is pressed against the rim of the opening of supplying port 55. These two, the supplying port 55 and replenishing roller 56 constitute the replenishing portion.

Toner replenishing roller 56 is formed of a porous material such as sponge etc. so that a large number of pores can be formed on its peripheral surface to retain toner 54 to be supplied to developer hopper 51. Therefore, as toner replenishing roller 56 rotates, the roller surface is scraped by the opening rim of supplying port 55 so that toner 54 retained by toner replenishing roller 56 is scraped off and supplied to developing hopper 51.

In order to supply toner 54 to toner replenishing roller 56, a rotatable agitator (rotator) 57 is arranged inside toner reserve container 50. This agitator 57 is rotationally driven on rotary shaft 57*a* so as to agitate toner 54 stored in toner reserve container 50. This agitator 57 is a type which is conventionally known and has no special configuration.

Briefly referring to the structure of this agitator 57, a pair of plates are arranged on both ends (on the front and rear sides in FIG. 2) of rotary shaft 57*a* with coil springs or the like tensioned therebetween. The coil springs are attached to the ends of the individual plates.

Rotary shaft 57*a* of agitator 57 is positioned at approximately the center of toner reserve container 50 as illustrated. Agitator 57 is fixed to this rotary shaft 57*a*, which is rotationally driven. Agitator 57 is attached to rotary shaft 57*a* off-centered.

More specifically, the plates (on the front side and rear sides) constituting agitator 57 are fixed to rotary shaft 57*a* so that for the distance of each plate from rotary shaft 57*a* to one end differs from that to the other, forming shorter and longer portions. Attached to the end of the side a shorter distance from rotary shaft 57*a* of agitator 57 is one end of a conveying sheet 58 of a flexible sheet-like element, which agitates the toner and conveys and pushes toner 54 to replenishing roller 56. That is, conveying sheet 58 is attached to agitator 57 in such a manner that the fixed portion thereof becomes closer to the rotary shaft 57*a* side. When rotary shaft 57*a* is arranged at the center of the plates on both ends of agitator 57, conveying sheet 58 may be attached to agitator 57 so as to be closer to rotary shaft 57*a*.

The distal free end on the side opposite to the fixed part, of conveying sheet 58 is positioned in proximity to the rear wall of toner reserve container 50 as shown by the broken line. In order to improve the efficiency of scooping up toner 54, the distal part of conveying sheet 58 may be flexed by an angle θ in the rotational direction of agitator 57, forming a toner retainer 58*a* in a contact manner. In particular, the length of conveying sheet 58 is designated so that the distal end of the flexed portion, i.e., toner retainer 58*a* can be placed in proximity to, either in contact or out of contact with, the right-hand inner wall (rear wall) of toner reserve container 50 on the side opposite to developer hopper 51, when the sheet is positioned as shown in FIG. 2.

A reference numeral 59 in the drawing designates an openable/closable lid constituting the top plate of toner reserve container 50, which is opened when toner 54 is loaded into toner reserve container 50. Accordingly, a large spacing can be secured between the openable/closable lid 59 and conveying sheet 58 in the condition shown in FIG. 2.

A reference numeral 42 designates a sensor for detecting the condition of the toner in the developer stored in developer hopper 51. This detecting sensor 42 is to detect, for example, the toner concentration in the developer, and outputs a signal indicating resupply of toner 54 if the toner concentration is equal or below a predetermined level. With this arrangement, the toner is replenished from toner reserve container 50 constituting the above toner replenishing device so that the toner concentration in developer hopper 51 can be continuously kept constant.

Here, the developer may be of a dual component or mono component type. A dual component developer is composed of a carrier and a toner and only the toner is consumed. Therefore, the ratio of the toner to the carrier decreases as development is carried out so that the toner concentration lowers. If a mono component developer is used, the amount of the toner in the developer hopper 51 decreases as the toner is consumed. The aforementioned sensor 42 detects the fact, whereby the amount of the toner having the prescribed properties is always controlled so as to be constant.

Now, the operation of developing unit 5 equipped with a toner replenishing device thus configured will be described next. Developing unit 5 is operated during image forming as stated above with reference to FIG. 5. That is, as developing roller 53 and agitating roller 52 are rotated, the static latent image formed on photoreceptor 1 is developed. When the toner in developer hopper 51 is consumed by the development, the decrease is detected by detecting sensor 42. In response to this detection, the toner replenishing device supplies the toner to the developer hopper 51.

For the toner supply, replenishing roller 56 and agitator 57 are rotated at the same time. As the agitator is driven, conveying sheet 58 deforms setting itself along the inner peripheral surface of toner reserve container 50 and agitates toner 54 accumulated at the bottom of toner reserve container 50 and scoops up the toner by retainer 58*a* of conveying sheet 58 and feeds it to toner replenishing roller 56. When supplied with the toner, toner replenishing roller 56 then retains the toner and releases it to developer hopper 51.

In this case, when conveying sheet 58, whilst holding the toner on its distal area, is rotated from the horizontal state shown in FIG. 2, the distal end fictionally abuts on openable/closable lid 59 as the top plate and gradually becomes deformed. The distal end of conveying sheet 58, as it is deformed by frictionally abutting openable/closable lid 59, becomes curved so that the toner held thereby can be efficiently fed to replenishing roller 56. In particular, provision of toner retainer 58*a*, the portion flexed by an angle of θ at the distal end of conveying sheet 58 enhances the toner holding function and enables efficient conveyance of the toner to replenishing roller 56 by eliminating toner spill more than is required.

Since the length of conveying sheet 58 is designated so that the distal end of conveying sheet 58 can be placed in proximity to the inner wall of toner reserve container 50 on the side opposite to developer hopper 51, it is possible to fully stir up or agitate toner 54 accumulated across the bottom surface of toner reserve container 50, thus making it possible to eliminate toner aggregation. Further, though conveying sheet 58 deforms itself as it frictionally moves along top openable/closable lid 59 with accumulated toner 54 held thereon, retainer 58*a*, the portion flexed in the rotational direction makes it possible to reliably feed the toner to replenishing roller 56.

Conveying sheet 58 of the present invention is formed of a flexible material and may be composed of, for example, resin film such as polyethylene terephthalate (PET). The provision of toner retainer 58*a* formed of a bent part at the distal end of conveying sheet 58 as shown in FIG. 2, further improves toner retaining capability and toner conveying performance to replenishing roller 56. These effects can be expected when the flexed angle θ of toner retainer 58*a* is set smaller than 90 degrees.

In view of improvement of toner conveyance, it has been also found experimentally that in order to secure the strength of conveying sheet 58 the length of toner retainer 58*a* is preferably set to be 20 to 60 times with respect to the thickness of the conveying sheet 58. For example, if the thickness of conveying sheet 58 is set within the range of 0.1 to 0.2 mm, it is most preferable that toner retainer 58*a* should be 5 to 6 mm long.

As described heretofore, in accordance with the developing unit 5 of the present invention, in particular, the toner replenishing device, the efficiency of scooping up and conveying toner 54 stored in toner reserve container 50 to replenishing roller 56 is improved. Actually, the superiority as to toner replenishment of the present invention was confirmed by the comparison of the case where the toner replenishing device of developing unit 5 having a configuration shown in FIG. 2 was used to perform toner replenishment with the case where the conventional toner replenishing device having a configuration shown in FIG. 1 was used. FIGS. 3A and 3B show the results.

The results shown FIGS. 3A and 3B were obtained as follows: That is, in each toner replenishing device, the agitator was turned so as to convey the toner in the toner reserve container to the replenishing roller which was also rotating. The distribution of the toner amount supplied from the supplying port as the replenishing roller rotates was checked across the full length of the rotary shaft. From these results, it was confirmed that the aforementioned conveying sheet 58 had a good toner conveying capability and supplied the toner in an approximately uniform way.

Figure 1:
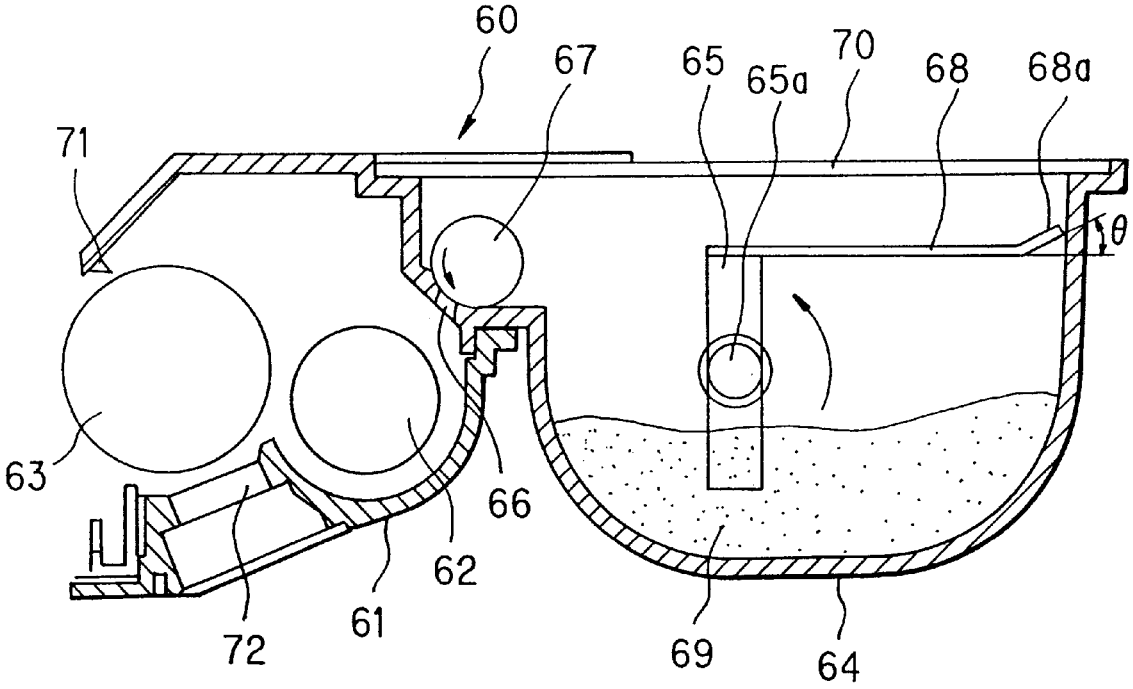
FIG. 1 PRIOR ART
FIG. 1 is a sectional view showing a specific example of a conventional developing unit equipped with a toner replenishing device.

FIG. 3B is the characteristic chart showing the result of toner supply or replenishing (falling) from supplying port 66 by the conventional configuration shown in FIG. 1. In particular, the supplied amount (falling amount) of the toner to the developing hopper is that of the toner falling from supplying port 66 as agitator 65 and toner replenishing roller 67 were rotated. In this case, three points, the front, the rear and the center, along the rotary shaft were checked to estimate the amount of the toner supply and determine the total amount of toner falling from supplying port 66.

The experimental result with the device having a configuration shown in FIG. 1 shows that the toner falling amount (supplied amount) from supplying port 66 when agitator 65 and replenishing roller 67 were continuously turned varied depending upon the point. That is, stable toner replenishment could not be anticipated because the toner supplied amounts at the front, the rear and the center increased or decreased locally.

Further, the total supply amount also varied considerably with the passage of the replenishing time. In particular, as the toner in toner reserve container 64 gradually decreased from the full state, the total amount of the supplied toner lowered considerably. When the amount of toner in toner reserve container 64 was reduced to half-full, the amount of the supplied toner gradually increased. In this way, the total supplied amount of toner will not become stabilized, posing a risk of image density fluctuations and density unevenness occurring as a result of the variation in toner amount in developer hopper 61. In order to prevent this, it is necessary to fully agitate the developer using agitating roller 62, which leads to delay of development and reduction in image forming speed.

FIG. 3A shows the evolution of toner replenishment as to developing unit 5 having a configuration shown in FIG. 2. As shown in this chart, the supplied amounts of toner or the amounts of the toner falling from supplying port 55, at the front, the rear and the center were approximately equal. This means that the supplied amount of toner by replenishing roller 56 is approximately uniform across the full length of the rotary shaft. That is, the toner conveyance performance of conveying sheet 58 is markedly stable and the sheet contributes to uniform and stable conveyance free from variations across the length of the rotational shaft. This effect is attributed to the attachment of conveying sheet 58 at the closer position to rotary shaft 57*a* of agitator 57.

Further, in developing unit 5 shown in FIG. 2, even when agitator 57 and replenishing roller 56 have been continuously turned, the amount of toner supplied through supplying port 55 was approximately constant. This result shows that the developing unit of this embodiment is able to perform stable toner replenishment of an approximately constant amount regardless of the amount of toner in toner reserve container 54.

The image quality was identified when development was actually carried out using the above configurations of toner replenishment. FIGS. 4A and 4B show the results. The evaluation was made by forming identical, solid black circles having a diameter of 50 mm at the front, the rear and the center in both the developing unit shown in FIG. 2 and in the conventional developing unit shown in FIG. 1.

The chart shown in FIG. 4A shows that the image density did not vary very much even with increased copy volume, so that developing unit 5 shown in FIG. 2 can present stable image density. Further, density unevenness or density variation across the whole image was not found, showing that development was of an approximately constant density and stable across the whole area.

On the other hand, in conventional developing unit 60 having a configuration shown in FIG. 1, the image density noticeably varied depending upon the amount of toner in toner reserve container 64, reflecting the result shown in FIG. 3B. Further, with the increase of the copy volume, the total image density varied, and the density across the image was inconstant, markedly producing local variations in image density. Moreover, the variations became more distinct as the copy volume increased.

Consequently, use of a developing unit having a configuration of the present invention shown in FIG. 2 makes it possible to realize stabilized toner replenishment, which is approximately uniform across the full length of the rotary shaft. Therefore, it is possible to stably supply the toner to the replenishing portion without depending upon the amount of toner 54 in toner reserve container 50, thus stabilizing the supplied amount of toner. Further, it is also possible to keep the density of the developed image uniform and constant, realizing stable image quality.

The Second Embodiment of the Present Invention

As stated above, the developing unit according to the first embodiment of the present invention can realize stabilized toner replenishment. This effect is peculiar to the configuration in which conveying sheet 58 is attached to a position closer to rotary shaft 57*a* of the rotary element, i.e., agitator 57.

Figure 6:
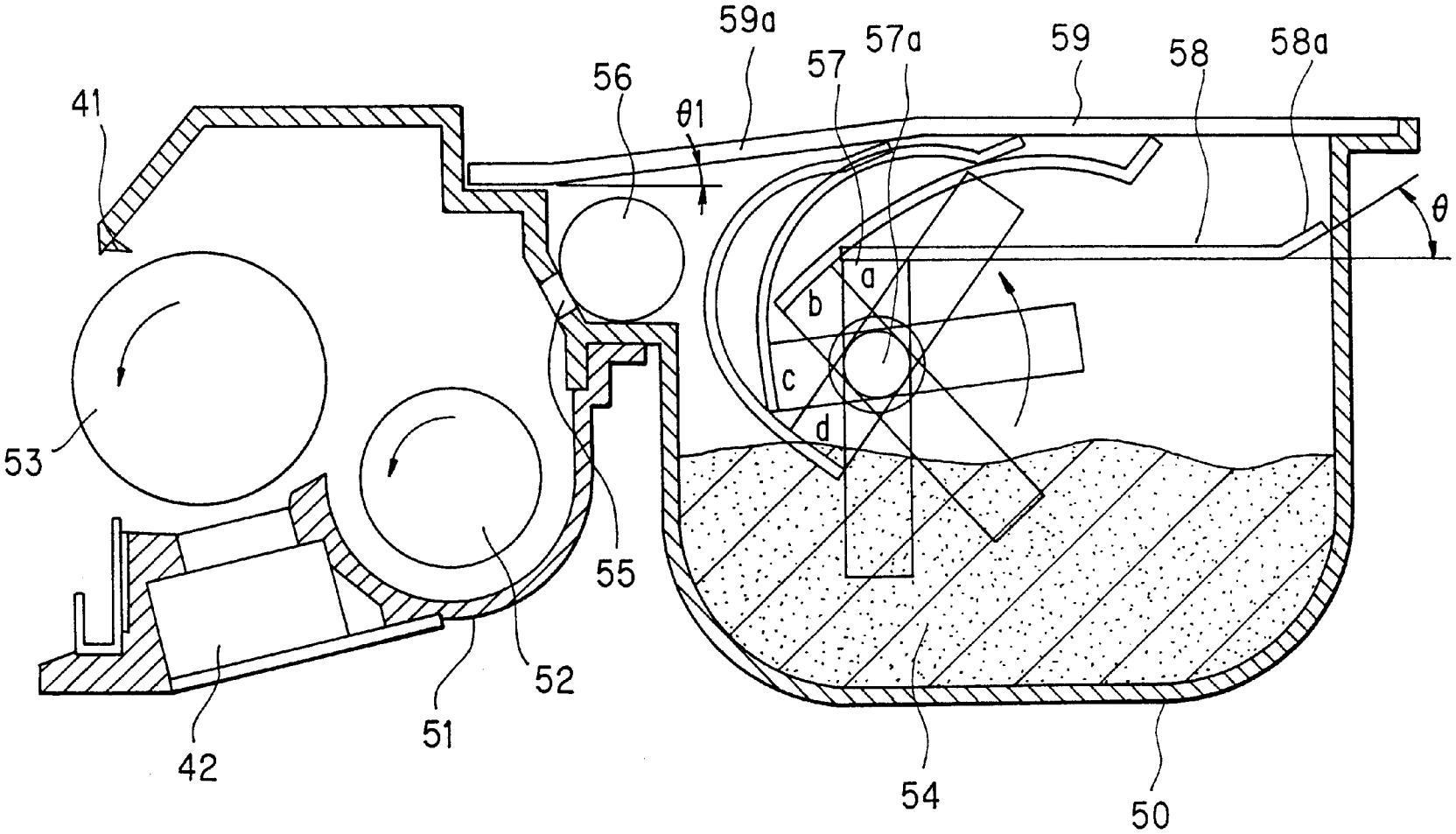
FIG. 6 is a sectional view for illustrating the configuration of the second embodiment of the developing unit equipped with a toner replenishing device of the present invention.

Conveying sheet 58 is gradually deformed and curved as it is frictionally abutted against top openable/closable lid 59 forming the top plate of toner reserve container 50. This situation is shown in FIG. 6. In the figure, when agitator 57, which is turning, stays at a position 'a' or in the vertical state, conveying sheet 58 is placed approximately parallel to openable/closable lid 59. As agitator 57 is turned and placed at a position 'b', the distal part of conveying sheet 58, in particular, the distal end of toner retainer 58*a* abuts openable/closable lid 59 so that the sheet is deformed and starts being bent because it is formed of a flexible element. When agitator 57 is positioned at 'c' after a further rotation, conveying sheet 58 is deformed greatly with its curvature increased.

Thereafter, when agitator 57 is turned to a position 'd', toner retainer 58*a* of conveying sheet 58 abuts openable/closable lid 59, in particular, the position directly above rotary shaft 57*a* of agitator 57. In this state, the curvature of conveying sheet 58 is at a maximum. In this case, if openable/closable lid 59 is horizontally flat as shown in FIG. 2, instead of a configuration shown in FIG. 6, the curvature of conveying sheet 58 gradually becomes smaller as agitator 57 continues to be rotated. Therefore, the toner on toner retainer 58*a* is conveyed to replenishing roller 56 by the restoring force when the curvature becomes smaller. If the restoring force is too strong such that conveying sheet 58 abruptly returns to its original state, the toner is flicked excessively so that the performance of conveyance can be expected to be lowered.

For countermeasures against this, the openable/closable lid 59 is formed with an incline 59*a* having an inclination of θ1 in such a manner that the top surface of lid 59 gradually descends from the position directly above rotary shaft 57*a* of agitator 57, for example, toward the replenishing portion or replenishing roller 56, as is shown in FIG. 6. This angle θ1 is that formed between the horizontal and the surface of incline 59*a*. Provision of this incline 59*a* prevents conveying sheet 58 from abruptly flipping back from the maximal curvature as agitator 57 rotates and enables gradual release of the repulsive force acting on the toner scooped up by toner retainer 58*a*, thus making it possible to realize a further efficient feed of the toner to replenishing roller 56. This incline 59*a* may be formed as a curved surface.

If the angle θ1 of incline 59*a* is too large, the spacing for conveying sheet 58 up to openable/closable lid 59 becomes too narrow so that the toner conveyance performance will lower. Therefore, the angle θ1 shown in FIG. 2 is preferably set within the range of 0 (including 0) to 15 degrees. If the angle exceeds 15 degrees, conveying sheet 58 comes too close to openable/closable lid 59 as stated above and the curvature of conveying sheet 58 becomes too large, causing the toner to spill out of retainer 58*a* and hence degrading the conveyance efficiency. This deficiency was confirmed from the experiment.

Incline 59*a* in FIG. 6 may and should be formed from the position where conveying sheet 58 is bent with its curvature maximum and from where the sheet gradually reverts itself back to its original shape.

In accordance with the configuration shown in FIG. 6, conveying sheet 58 is positively formed with a toner retainer 58*a* that is bent by angle θ. The object of the present invention, however, can be attained by using a flat configuration as shown by the broken line in FIG. 2. Also, toner reserve container 50 is enlarged to some degree in the lateral (horizontal) direction compared to the configuration shown in FIG. 2, so as to increase the storing capacity of toner 54. Rotary shaft 57*a* of agitator 57 is arranged at the approximate center with respect to the vertical direction of toner reserve container 50 and off-centered closer to toner replenishing roller 56. Further, the distal end of conveying sheet 58 is adapted to be proximal to the rear wall surface of toner reserve container 50 when agitator 57 is placed at position 'a' in FIG. 6.

The arrangement as above assures a large storing capacity of toner reserve container 50 and permits sufficient agitation of toner 54 in toner reserve container 50 by conveying sheet 58 and hence prevention of toner aggregation therein, thus making it possible to convey substantially all toner 54 stored therein to replenishing roller 56.

The Third Embodiment of the Present Invention

In accordance with the above first and second embodiments, conveying sheet 58 is attached in proximity to rotary shaft 57*a* of agitator 57. By this configuration, the amount of bending of conveying sheet 58 that abuts openable/closable lid 59 as the top plate can be suppressed as much as possible, thus producing the effect of making the bending state across the full length of the rotary shaft uniform. Thus, the supplied amount of toner can be stabilized while uniform supply of toner to replenishing roller 56 across the full length in the axial direction is made possible.

The third embodiment aims at stabilizing the bending of conveying sheet 58, that is, bending the sheet uniformly across the full length in the axial direction to thereby realize stable toner replenishment. In order to stabilize the amount of bending of conveying sheet 58, a recessed or projected portion is formed on the openable/closable lid 59.

Figure 7A:
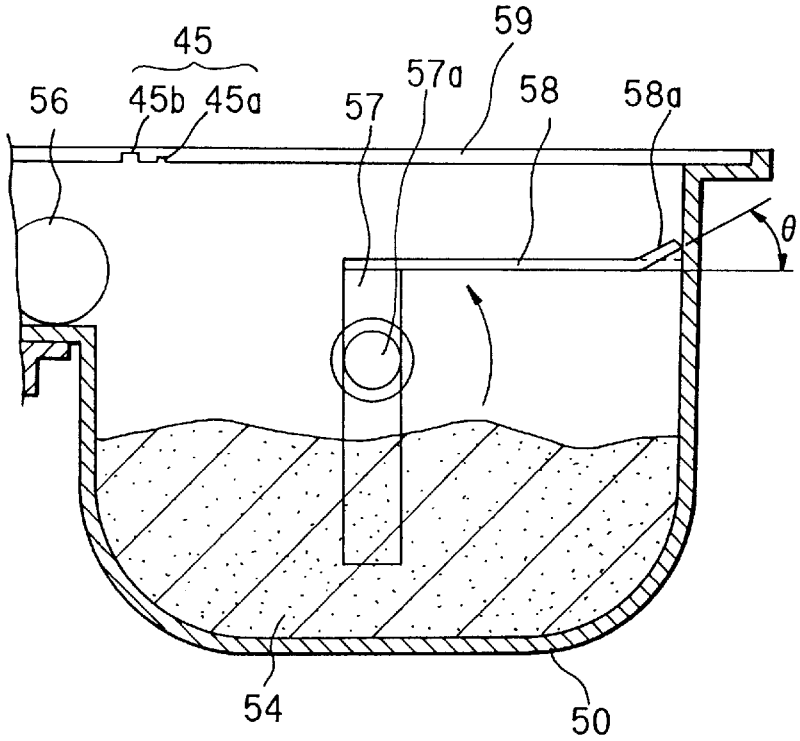
FIGS. 7A and 7B are sectional views for illustrating the configuration of the third embodiment of the developing unit equipped with a toner replenishing device of the invention.
Figure 7B:
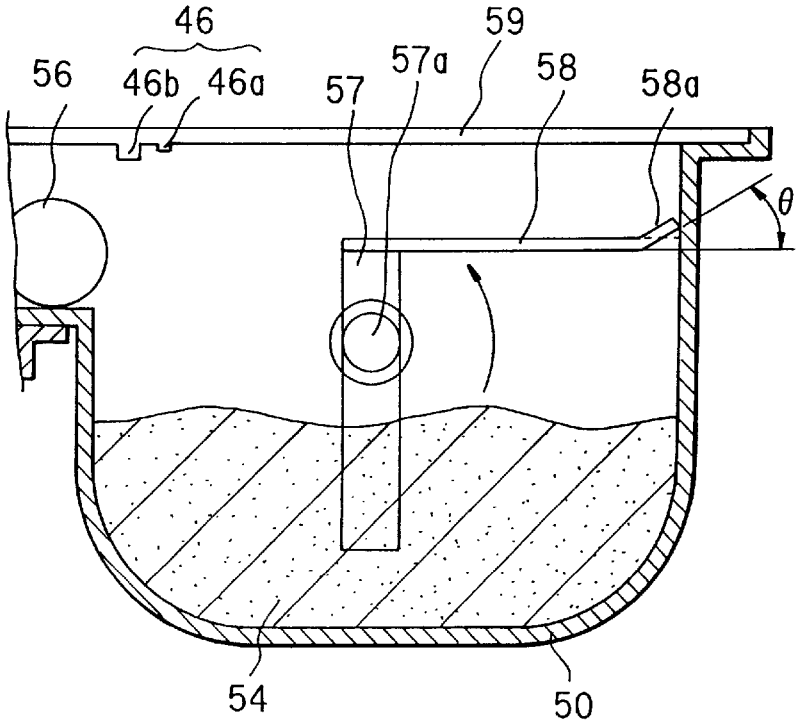

FIGS. 7A and 7B show the examples. In FIGS. 7A and 7B, at least one, or two or more of recesses 45 or projections 46 are formed on the inner side of openable/closable lid 59, that is, the surface against which conveying sheet 58 abuts. Recessed portion 45 or projected portion 46 is formed in parallel to the axial direction of replenishing roller 56. That is, recessed portion 45 or projected portion 46 is formed so that the distal end of conveying sheet 58 will be gripped across its full length by the recessed portion 45 or projected portion 46.

In the configurations shown in FIGS. 7A and 7B, recessed portion 45 or projected portion 46 has a rectangular section, but they may be of a trapezoidal, V-shaped triangular, semicircular (R) shape or other shape, arbitrarily selected. In the figure, two recesses 45*a*, 45*b* or projections 46*a*, 46*b* are formed, but one or three or more can be optionally selected.

To begin with, the operation of a configuration shown in FIG. 7A where recessed portion 45 is formed will be described. As agitator 57 is turned, the distal end of conveying sheet 58 abuts the inner surface of the top plate, i.e., openable/closable lid 59 and becomes bent gradually. Then, the distal end of conveying sheet 58 slips into recessed portion 45 and is caught thereby. Therefore, if the bending state of conveying sheet 58 while being bent is in imbalance, the bent sheet as a whole is corrected to a uniform bending state by restraining of recessed portion 45.

Further, since the bending of conveying sheet 58 is corrected and uniformly formed, the toner scooped by the distal part of conveying sheet 58 is stabilized so that its supply amount and its supplying distribution across the full length along the axial direction are made uniform. Therefore, the conveying sheet can replenish the toner to replenishing roller 56 in a stable manner as agitator 57 rotates. In this case, when conveying sheet 58 is positioned close to rotary shaft 57*a* of agitator 57 as shown in FIGS. 7A and 7B, the sheet is less curved when it is bent, so that it is possible to form a good bending state and hence supply the toner in a stable manner. The configuration of the distal end of conveying sheet 58 being flexed at an angle of θ, further can increase the supplied amount of toner.

If a multiple number of recesses 45 for setting the bending state of conveying sheet 58 uniform, are provided, the bending of conveying sheet 58 can be corrected more uniformly. Illustratively, if the sheet is fitted into recess 45*a* first but cannot be corrected adequately, the sheet can surely be reformed into a uniform bending state when it is caught by the next recess 45*b*.

In the case shown in FIG. 7A, the groove of recess 45*b* on the downstream side (closer to replenishing roller 56) with respect to the rotational direction of conveying sheet 58 is larger in depth and/or width than that of recess 45*a* located on the upstream side. This configuration is to prevent the toner retained conveying sheet 58 from spilling out or being scraped by the catch when conveying sheet 58 becomes fitted into upstream recess 45*a* and corrected as to its bending state. This is why the depth or width (i.e., the catch) of the groove of recess 45*a* is set smaller than recess 45*b* (the last recess).

Since the conveying sheet needs to be set in a uniformly bending state by the final catching of recess 45*b* on the most downstream side in order to supply the toner uniformly to replenishing roller 56, the depth and width (distance with respect to the direction in which the conveying sheet moves) of recess 45*b* (the size of the catch) is formed greater, whereby it is possible to bend the sheet in a beneficial manner whilst keeping the retained toner from spilling out. Thus, the retained toner can be positively thrown off and stably supplied to replenishing roller 56 making use of the elastic force of the bent conveying sheet 58.

The above description was made of the replenishing function of conveying sheet 58 when recessed portion 45 shown in FIG. 7A is formed. Differing from the above configuration, projected portion 46 shown in FIG. 7B can also produce the same function as recessed portion 45. The operation and effects are analogous so that they will not be repeated. With the projected portion 46, it catches the distal end of conveying sheet 58 so as to correct the bent sheet into a uniform bending state. The configurations, such as the number, dimensions or width of the projections on the upstream and downstream sides are quite similar to the case of recessed portion 45 described above. In the case of FIG. 7B, two projections 46*a*, 46*b* are formed and the dimensions (projected amount) of projection 46*b* on the downstream side is set greater and wider than that of the projection 46*a* on the upstream side.

As a configuration of recessed portion 45 and projected portion 46, if three or more recesses or projections are formed, two adjacent elements may be equal-distantly arranged. Alternatively, if the distance between two adjacent elements is reduced, it is possible to vibrate conveying sheet 58 so as to promote the separation of the retained toner from the sheet and its replenishment.

Here, recessed portion 45 or projected portion 46 should be positioned downstream, with respect to the rotational direction of conveying sheet 58, of a point directly above shaft 57*a* of agitator 57, in particular, close to replenishing roller 56. This positioning facilitates stabilization of the bending state of conveying sheet 58 before it supplies the toner to replenishing roller 56 and hence provides uniform amount of replenishment of the toner across the full length in the axial direction.

Further, if conveying sheet 58 is attached in the normal position, that is, the position corresponding to that on the opposite side of agitator 57, in place of being attached to the position described in the first embodiment, the bending state of the sheet can be set uniform and hence the supplied amount of toner can be stabilized. Moreover, if the configuration described in the first embodiment is adopted, or when conveying sheet 58 is attached closer to rotary shaft 57*a* of agitator 57 as shown in FIG. 7A, the supplied amount of toner is further stabilized.

Figure 8A:
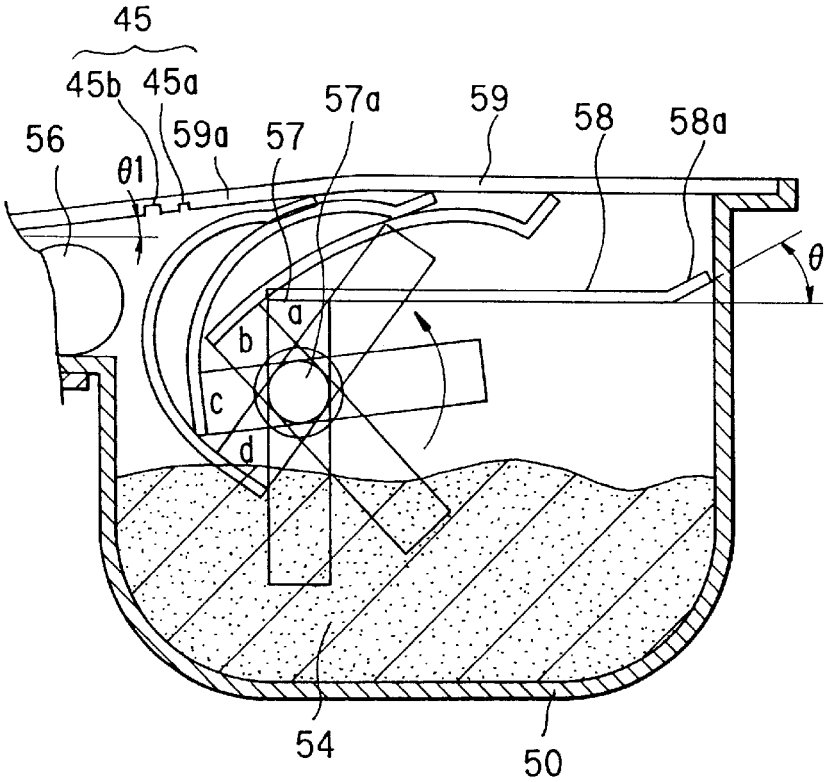
FIGS. 8A and 8B are sectional views for illustrating variational examples of toner supplying devices in accordance with the third embodiment of the present invention.
Figure 8B:
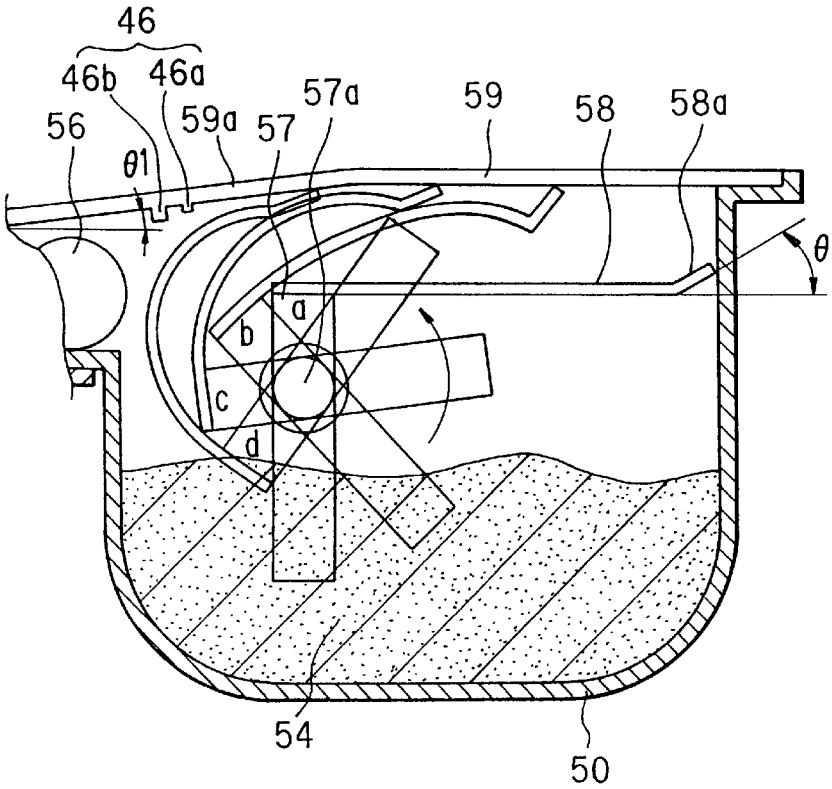

Also, in a case where openable/closable lid 59 is formed so that the side closer to replenishing roller 56 is gradually descended as has been described in the second embodiment shown in FIG. 6, recessed portion 45 or projected portion 46 of the third embodiment may be formed in the area of incline 59*a* having an inclination of θ1. In this case, the stabilizing effect on the supplied amount of toner can be further promoted. FIGS. 8A and 8B show the examples.

Recessed portion 45 and projected portion 46 shown in FIGS. 8A and 8B are formed in the same manner as described with reference to FIGS. 7A and 7B, and the number and configurations are the same as before.

Also in the case of the third embodiment where recessed portion 45 or projected portion 46 is formed, the supplied state of the toner can be stabilized as described with reference to FIGS. 3A and 3B and FIGS. 4A and 4B. Resultantly, it is possible to produce an image of uniform density, in particular, uniform in toner density over the whole range.

In the configurations shown in FIGS. 8A and 8B, toner reserve container 50 is elongated to the side opposite developer hopper 51 while rotary shaft 57*a* of agitator 57 is positioned closer to replenishing roller 56 in combination with a longer conveying sheet 58. By this arrangement, an adequate amount of toner replenishment can be secured while beneficial agitation of toner 54 in toner reserve container 50 can be carried out by virtue of elongated conveying sheet 58, having a large flexure of the sheet during toner replenishment. In this case, if the bending state is uniformly corrected as described in the third embodiment, it is possible to realize uniform toner supply with an adequate amount of toner.

Other Variations of the Third Embodiment

In accordance with the third embodiment described with reference to FIGS. 7A and 7B and FIGS. 8A and 8B, recessed portion 45 or projected portion 46 is formed on the top plate or openable/closable lid 59. In place of these, the area on the inner surface of openable/closable lid 59 in contact with conveying sheet 58 may be partially roughened forming a rough-faced portion 47 as shown in FIGS. 9A and 9B.

Figure 9A:
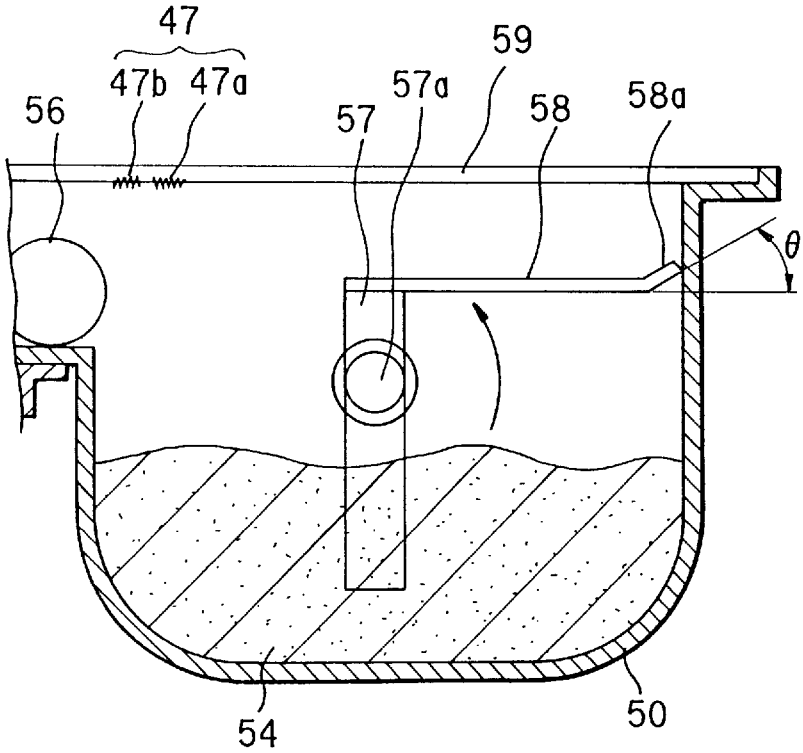
FIGS. 9A and 9B are sectional views for illustrating other variational examples of toner supplying devices in accordance with the third embodiment of the present invention.
Figure 9B:
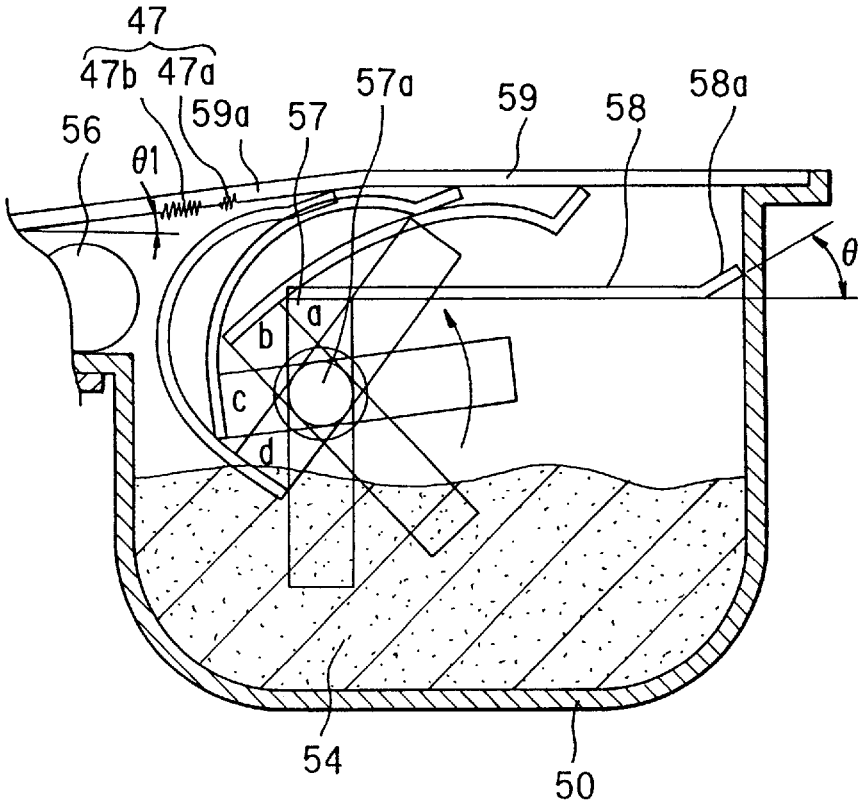

Rough-faced portion 47 should be formed of at least one section, and may be formed of multiple sections arranged apart from each other by the predetermined distance, as shown in FIGS. 9A and 9B. In this way, rough-faced portion 47 grips distal end 58*a* of conveying sheet 58 similarly to recessed and projected portions 45 and 46 so as to make the flexure of bent, conveying sheet 58 uniform, thus making it possible to make more even the conveyed amount of toner to replenishing roller 56 across the full length in the axial direction.

In the case of rough-faced portion 47, multiple rough-faced sections 47*a* and 47*b* may be formed in an identical manner, as shown in FIG. 9A. Alternatively, the first rough-faced section 47*a* may be set short in its width while the last rough-faced section 47*b* may be set long in its width as shown in FIG. 9B. Thus, similarly to the case where recesses 45 or projections 46 are formed greater in their depth or in their height toward the downstream side (the greatest at the most downstream position), these configurations are to retard and catch the distal end of conveying sheet 58 in an enhanced manner and enhance the effect of toner replenishment by surely flicking the toner when the flexure of the sheet has been made uniform and the toner is fed to replenishing roller 56.

In the above case, rough-faced sections 47*a* and 47*b* may be differentiated in their surface roughness. Actually, when the surface roughness of roughened section 47*b* is formed more coarsely than that of rough-faced section 47*a*, the front end of conveying sheet 58 is gripped more strongly by the last, rough-faced section 47*b* than rough-faced section 47*a*, so that the above effect can be expected.

Further, similarly to the configurations of recessed and projected portions 45 and 46, the rough-faced portion 47 shown in FIG. 9A is formed on the inner surface of openable/closable lid 59 as the top plate, at a position on the side closer to replenishing roller 56, or at a position downstream of and still within the range in which conveying sheet 58 frictionally abuts the top plate. The rough-faced portion 47 shown in FIG. 9B is formed on incline 59*a* of openable/closable lid 59. That is, in both cases, the rough-faced portion is formed close to replenishing roller 56.

This positioning of the roughened portion is effective in producing the same effect as described about recessed and projected portions 45 and 46.

Figure 10:
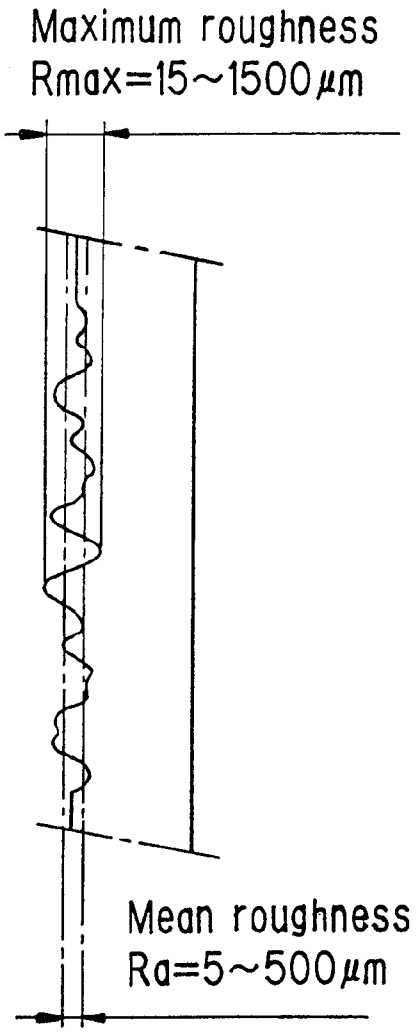
FIG. 10 is a view for illustrating the surface roughness in the rough-faced portion in the toner replenishing device in FIGS. 9A and 9B.

The roughness of the rough-faced portion 47 can be specified by making use of the standard defined by, for instance, JIS as shown in FIG. 10. As in FIG. 10, setting of the mean roughness Ra of rough-faced portion 47 within the range of 5 to 500 $\mu$m assures reliable grip of the end of conveying sheet 58. Further, limitation of maximum roughness Rmax, which is the difference between the maximum peak (crest) and the minimum peak (trough), within the range of 15 to 1500 $\mu$m, in combination with the limitation of the mean roughness Ra, can produce the desired effect. In this case, if these factors are out of the above ranges, the reliability will lower though a certain extent of gripping effect of conveying sheet 58 can be expected. Setting these factors at values too large, enhances the gripped state but the sheet is hard to release from the grip, resulting in unstable toner supply.

Therefore, it is of great importance and preferable to set the surface roughness within the above range shown in FIG. 10. When multiple rough-faced sections 47*a* and 47*b* are formed, the surface roughness should be set appropriately within the above range while rough-faced section 47*b* is set more coarsely than rough-faced section 47*a*.

Figure 11A:
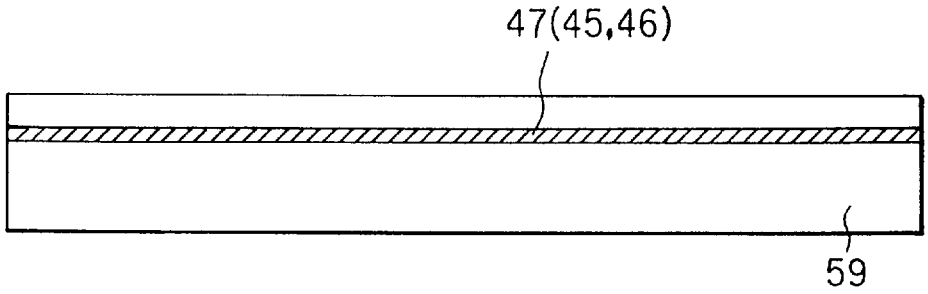
FIGS. 11A to 11D are views showing various rough-faced portions and recessed and projected portions in the third embodiment of the present invention.
Figure 11B:
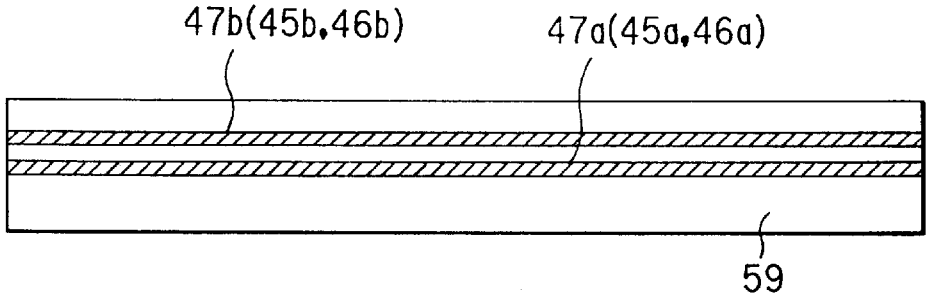

In the above configurations having rough-faced portion 47, recessed portion 45 and projected portion 46, each element is formed on the inner surface of the top plate or openable/closable lid 59 across the full length of shaft 57*a* of agitator 57, for instance. That is, as shown in FIGS. 11A and 11B, rough-faced portion 47 (47*a* and 47*b*), recessed portion 45 (45*a* and 45*b*) and projected portion 46 (46*a* and 46*b*) are formed across the full length in the axial direction (in the longitudinal direction) over the openable/closable lid 59.

Figure 11C:
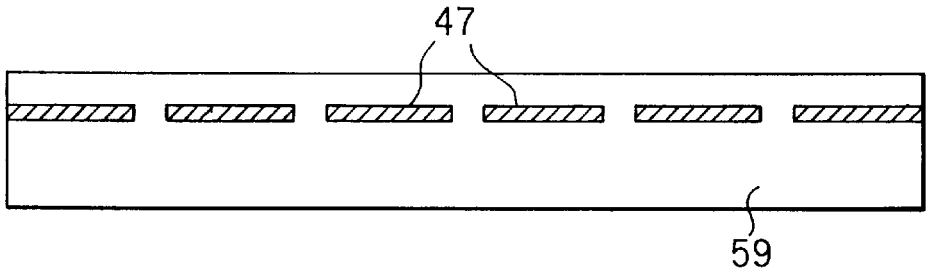
Figure 11D:
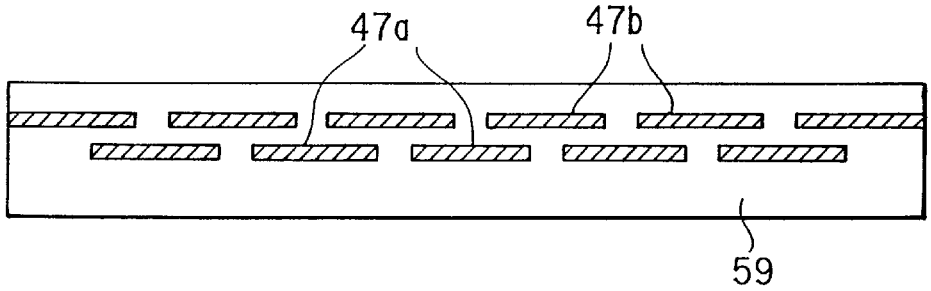

Instead, rough-faced portion 47 may be formed in a separated manner as shown in FIGS. 11C and 11D with respect to the axial direction, producing the similar effect. That is, the distal end of conveying sheet 58 being caught partially by the rough surface is good enough to align the distal end. Therefore, rough-faced portion 47 (47*a* and 47*b*) may be formed of multiple separated sections arranged in the axial direction so as to produce the same effect. If recessed portion 45 or projected portion 46 is formed as shown in FIG. 11C or 11D, the conveying sheet 58 cannot be gripped by the empty portions, slipping thereon, so that the bending state of conveying sheet 58 may show instability. Further, the sheet may be irregularly set by partial gripping, failing to perform stable toner replenishment.

For these reasons, the arrangements shown in FIGS. 11C and 11D can be applied only to the case of rough-faced portion 47. Rough-faced section 47*b* may be formed in the same manner as and in parallel with rough-faced section 47*a*. Alternatively, rough-faced sections 47*a* and 47*b* may be arranged in a staggered manner as illustrated so that the sections 47*b* make up for the gaps between sections 47*a*. This produces a further effective result.

For rough-faced portion 47 which is formed by roughening the surface of openable/closable lid 59, the rough-face texture may be formed at random or regularly by knurling. Particularly, since it is possible to form a separated configuration as shown in FIGS. 11C and 11D when a rough-faced portion 47 is formed, there is no need to provide it across the full range unlike recessed portion 45 or projected portion 46 is needed to. So the distal end of conveying sheet 58 can be gripped gradually or delicately. That is, this configuration further offers the advantage of eliminating the risk of the scooped toner being spilt by a strong vibration of conveying sheet 58 when the sheet is abruptly gripped. Therefore, a large amount of the toner supplied to replenishing roller 56 can be secured while an enhanced uniform replenishment in the axial direction can be expected.

Also in the configuration using rough-faced portion 47 discussed above, it was confirmed that a stabilized toner supply state can be obtained as in the description as to FIGS. 3A and 3B and FIGS. 4A and 4B. Resultantly, it is possible to produce an image of uniform density, in particular, uniform in toner density over the whole range.

Further, as shown in FIGS. 9A and 9B, whether toner retainer 58*a* at the distal end of conveying sheet 58 is inclined or not, provision of rough-faced portion 47 enables stable toner replenishment. When conveying sheet 58 is attached close to shaft 57*a* of agitator 57 or further when shaft 57*a* of agitator 57 is set off the center of toner reserve container 50 to the side closer to replenishing roller 56, the same effects as in the configurations of recessed portion 45 and projected portion 46 can be obtained.

Moreover, when recessed portion 45, projected portion 46 or rough-faced portion 47 in the third embodiment is formed with multiple sections, instead of a single element, these sections can be used in combination. For example, a rough-faced portion 47 may be provided as a regulating element for setting the curved conveying sheet 58 into an aligned bending state while a recessed portion 45 or projected portion 46 may be formed as the final element when the toner is flicked to replenishing roller 56.

As has been described heretofore, in accordance with the developing unit equipped with a toner replenishing device, it is possible to efficiently feed the toner to the toner replenishing portion through which the toner is supplied to the developer hopper of the developing unit. Hence, image unevenness due to partial toner supply, that is, density unevenness of development can be reduced so as to keep good image quality.

Since the toner replenishing device facilitates substantially uniform toner conveyance for toner replenishment across the full range of development, without partial failure of conveyance, securing satisfactory development without any local fluctuations of the amount of toner.

Particularly, the object of the invention can be attained by a very simple configuration without the necessity of a significant modification of the conventional toner replenishing device except by the simple changing of the attached position of the conveying sheet for conveying the toner to the replenishing portion.

Further, simple modification of the shape of the top lid defining the toner reserve container storing the toner can improve the conveyance performance of the toner to the replenishing portion and enables stable toner replenishment at an adequate amount of toner, which leads to satisfactory development.

Finally, provision of the recessed portion, projected portion or rough-faced portion for the top lid of the toner reserve container makes it possible to set the conveying sheet in a corrected, bending state, leading to the supplied amount of toner being made uniform across the whole range.

In this case, formation of multiple elements of the above enhances stability of the supplied amount of toner and the selected combination of the above further increases the reliability of toner replenishment.

What is claimed is:

1. A developing unit equipped with a toner replenishing device having a toner reserve container for replenishing toner to a developing hopper as required and a replenishing portion for supplying toner stored in the toner reserve container to the developing hopper, comprising:

an agitator fixed to a rotary shaft having shorter and longer portions with a flexible conveying sheet attached to the shorter portion thereof incorporated in the toner reserve container so as to be rotatable for agitating stored toner; and the conveying sheet of a flexible material arranged so as to become closer to the rotary shaft of the agitator, for scooping up the stored toner and conveying it to the replenishing portion, wherein the distal end of the conveying sheet on contact with a top plate of the toner reserve container assumes a curved shape along substantially its total length with an inner surface of the curved shape facing the rotary shaft.

2. A developing unit equipped with a toner replenishing device having a toner reserve container for replenishing toner to a developing hopper as required and a replenishing portion for supplying toner stored in the toner reserve container to the developing hopper, comprising:

a rotator incorporated in the toner reserve container so as to be rotatable for agitating stored toner; and a conveying sheet of a flexible material attached to the rotator for scooping up the stored toner and conveying it to the replenishing portion, characterized in that a top plate of the toner reserve container with which the distal end of the conveying sheet comes in contact is provided with a recessed portion, projected portion or rough-faced portion made up of one or multiple sections or any combination of these so as to briefly grip the distal end of the conveying sheet.

3. A developing unit equipped with a toner replenishing device having a toner reserve container for replenishing toner to a developing hopper as required and a replenishing portion for supplying toner stored in the toner reserve container to the developing hopper, comprising:

a rotator incorporated in the toner reserve container so as to be rotatable for agitating stored toner; and a conveying sheet of a flexible material arranged so as to become closer to a rotary shaft of the rotator, for scooping up the stored toner and conveying it to the replenishing portion;

wherein a top plate constituting an upper part of the toner reserve container has a portion inclined or curved toward the replenishing portion so as to prevent the conveying sheet from abruptly springing back from its flexed state to its original shape when the conveying sheet feeds the toner to the replenishing portion as its distal end abuts against and slides along the top plate and allows the conveying sheet to gradually restore itself.

4. A developing unit equipped with a toner replenishing device having a toner reserve container for replenishing toner to a developing hopper as required and a replenishing portion for supplying toner stored in toner reserve container to the developing hopper, comprising:

a rotator incorporated in the toner reserve container so as to be rotatable for agitating stored toner; and a conveying sheet of a flexible material attached to the rotator for scooping up the stored toner and conveying it to the replenishing portion, characterized in that a top plate of the toner reserve container with which the distal end of the conveying sheet comes in contact is provided with a recessed portion, projected portion or rough-faced portion made up of one or multiple sections or any combination of these so as to briefly grip the distal end of the conveying sheet, wherein the top plate constituting an upper part of the toner reserve container has a portion inclined or curved toward the replenishing portion so as to prevent the conveying sheet from abruptly springing back from its flexed state to its original shape when the conveying sheet feeds the toner to the replenishing portion as its distal end abuts against and slides along the top plate and allows the conveying sheet to gradually restore itself.

5. The developing unit equipped with a toner replenishing device according to claim 3, wherein the inclined or curved portion formed in the top plate originates from a point where the conveying sheet starts reverting itself to its original shape from its maximally flexed state.

6. The developing unit equipped with a toner replenishing device according to claim 4, wherein the inclined or curved portion formed in the top plate originates from a point where the conveying sheet starts reverting itself to its original shape from its maximally flexed state.

7. The developing unit equipped with a toner replenishing device according to claim 3, wherein the inclined or curved portion of the top plate is angled with an angle $\theta 1$ which is equal to or smaller than 15 degrees.

8. The developing unit equipped with a toner replenishing device according to claim 4, wherein the inclined or curved portion of the top plate is angled with an angle $\theta 1$ which is equal to or smaller than 15 degrees.

9. The developing unit equipped with a toner replenishing device according to claim 1, wherein the conveying sheet is formed with such a length that its distal end is placed in proximity to a rear wall of the toner reserve container when the conveying sheet is positioned in parallel to the top plate of toner reserve container and the distal end part is flexed at an angle $\theta$ to form a toner retainer.

10. The developing unit equipped with a toner replenishing device according to claim 4, wherein the conveying sheet is formed with such a length that its distal end is placed in proximity to a rear wall of the toner reserve container when the conveying sheet is positioned in parallel to the top plate of toner reserve container and the distal end part is flexed at an angle $\theta$ to form a toner retainer.

11. A developing unit equipped with a toner replenishing device having a toner reserve container for replenishing toner to a developing hopper as required and a replenishing portion for supplying toner stored in the toner reserve container to the developing hopper, comprising:

a rotator incorporated in the toner reserve container so as to be rotatable for agitating stored toner; and a conveying sheet of a flexible material attached to the rotator for scooping up the stored toner and conveying it to the replenishing portion, characterized in that a top plate of the toner reserve container with which the distal end of the conveying sheet comes in contact is provided with a recessed portion, projected portion or rough-faced portion made up of one or multiple sections or any combination of these so as to briefly grip the distal end of the conveying sheet, wherein the recessed, projected or rough-faced portion formed on the top plate constituting the toner reserve container is formed of multiple sections arranged one behind another with respect to the rotational direction of the conveying sheet, and the recessed, projected or rough-faced section on the downstream side provides a stronger grip than that on the upstream side.

12. The developing unit equipped with a toner replenishing device according to claim 4, wherein a recessed, projected or rough-faced portion formed on the top plate constituting the toner reserve container is formed close to the replenishing portion.

13. The developing unit equipped with a toner replenishing device according to claim 4, wherein the conveying sheet is attached at its one end in proximity to a rotary shaft of the rotator.

14. The developing unit equipped with a toner replenishing device according to claim 11, wherein a rough-faced portion formed on the top plate constituting the toner reserve container is specified so that the mean roughness (Ra) is set within the range of 5 to 500 $\mu$m and the maximum roughness (Rmax) is set within the range of 15 to 1500 $\mu$m.

* * * * *